US008382918B2

(12) United States Patent
Yoshihara et al.

(10) Patent No.: US 8,382,918 B2
(45) Date of Patent: Feb. 26, 2013

(54) STEEL WIRE MATERIAL FOR SPRING AND ITS PRODUCING METHOD

(75) Inventors: Nao Yoshihara, Kobe (JP); Fujio Koizumi, Kobe (JP); Hirokazu Inoue, Kobe (JP); Katsuya Takaoka, Kobe (JP); Shoji Miyazaki, Kobe (JP); Sayaka Nagamatsu, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/172,270

(22) Filed: Jun. 29, 2011

(65) Prior Publication Data

US 2011/0303327 A1 Dec. 15, 2011

Related U.S. Application Data

(63) Continuation of application No. 12/171,807, filed on Jul. 11, 2008, now abandoned.

(30) Foreign Application Priority Data

Jul. 20, 2007 (JP) ..... 2007-190000
Jul. 20, 2007 (JP) ..... 2007-190001

(51) Int. Cl.

| | |
|---|---|
| ***C21D 9/02*** | (2006.01) |
| *C21D 11/00* | (2006.01) |
| *C22C 38/00* | (2006.01) |
| *B32B 15/00* | (2006.01) |
| *C25D 5/10* | (2006.01) |

(52) U.S. Cl. ..... 148/580; 148/332; 148/506; 428/682

(58) Field of Classification Search ..... 148/332, 148/506, 580; 428/682

See application file for complete search history.

(56) References Cited

U.S. PATENT DOCUMENTS

| | | | |
|---|---|---|---|
| 5,508,002 | A | 4/1996 | Kawaguchi et al. |
| 5,846,344 | A | 12/1998 | Kawaguchi et al. |
| 6,406,565 | B1 | 6/2002 | Hashimura et al. |
| 7,438,770 | B2 | 10/2008 | Yuse et al. |
| 2006/0169367 | A1 | 8/2006 | Yuse et al. |
| 2006/0225819 | A1 | 10/2006 | Yoshihara |
| 2007/0256765 | A1 | 11/2007 | Kimura et al. |
| 2008/0308195 | A1 | 12/2008 | Yoshihara et al. |

FOREIGN PATENT DOCUMENTS

| | | | |
|---|---|---|---|
| EP | 0 943 697 | A1 | 9/1999 |
| EP | 1 698 712 | A1 | 9/2006 |

(Continued)

OTHER PUBLICATIONS

Extended European Search Report issued Sep. 9, 2011, in Patent Application No. 11004880.8.

(Continued)

*Primary Examiner* — Stanley Silverman
*Assistant Examiner* — Alexander Polyansky
(74) *Attorney, Agent, or Firm* — Oblon, Spivak, McClelland, Maier & Neustadt, L.L.P.

(57) ABSTRACT

The steel wire material for a spring of the invention contains; C: 0.37-0.54%, Si: 1.7-2.30%, Mn: 0.1-1.30%, Cr: 0.15-1.1%, Cu: 0.15-0.6%, Ti: 0.010-0.1%, Al: 0.003-0.05%, and the balance including iron with inevitable impurities, wherein ferrite decarburized layer depth is 0.01 mm or less, whole decarburized layer depth is 0.20 mm or less, and fracture reduction of area is 25% or more. It alternately may contain; C: 0.38-0.47%, Si: 1.9-2.5%, Mn: 0.6-1.3%, Ti: 0.05-0.15%, Al: 0.003-0.1%, and the balance including iron with inevitable impurities, wherein ferrite decarburized layer depth is 0.01 mm or less.

25 Claims, 2 Drawing Sheets

FOREIGN PATENT DOCUMENTS

| | | | | |
|---|---|---|---|---|
| EP | 1 712 653 | A1 | | 10/2006 |
| EP | 1 783 239 | A1 | | 5/2007 |
| FR | 2 894 987 | | | 6/2007 |
| JP | 7-173577 | | | 7/1995 |
| JP | 10-287958 | | | 10/1998 |
| JP | 2000-256740 | | | 9/2000 |
| JP | 2002-47539 | | | 2/2002 |
| JP | 2002-97543 | | | 4/2002 |
| JP | 2002-194432 | | | 7/2002 |
| JP | 2003-268453 | | | 9/2003 |
| JP | 2003268483 | A | * | 9/2003 |
| JP | 2004-10965 | | | 1/2004 |
| JP | 2006-241528 | | | 9/2006 |
| JP | 2007-9300 | | | 1/2007 |
| KR | 2003798635 | | * | 7/2003 |
| WO | WO 2006/022009 | A1 | | 3/2006 |

OTHER PUBLICATIONS

So-Ichi Izumi, et al., "Effect of Reheating Conditions on the Decarburization Behaviour in High-Silicon Spring Steel Wire Rods (Study on the Production of High-Silicon Spring Steel Wire Rods—II)", Transactions ISIJ, XP009109672, vol. 23, 1983, 1 page.

Office Action issued Aug. 8, 2010, in Korean Application No. 2008-0069987, filed Jul. 18, 2008.

Office Action issued Sep. 9, 2010, in Chinese Application No. 2008-101361213, filed Jul. 9, 2008.

Japanese Office Action issued on Jan. 25, 2011 in corresponding Japanese Application No. 2008-184734.

Katsunori Takada et al., "Effects of Heating Conditions on Decarburization of High Si Spring Steel", Tetsu-to-Hagane (Japan), 1986, vol. 72, No. 5, p. S659 (with an English Translation).

Jiro Tominaga et al., "Ferrite Decarburization of Si-Cr Spring Steel", Tetsu-to-Hagane (Japan), 1980, vol. 66, No. 11, p. S1278 (with an English Translation).

Kazuyoshi Kimura et al., "Influence of Alloy element on Corrosion Fatigue Life of Spring Steels", Denki-Seikou (Electric Furnace Steel), 2004, vol. 75, No. 1, pp. 19-25 (with an English Abstract).

Masataka Shimotsusa, et al., "Wire Rod for Suspension Spring with Excellent Corrosion Fatigue Life", Wire Journal International, vol. 31, No. 3, Mar. 1, 1998, XP009109677, pp. 78-83.

Notification of Reason(s) for Refusal issued Mar. 27, 2012 in Japanese Patent Application No. 2008-184733 (with English translation).

U.S. Appl. No. 13/511,541, filed May 23, 2012, Nagamatsu, et al.

* cited by examiner

STEEL WIRE MATERIAL FOR SPRING AND ITS PRODUCING METHOD

BACKGROUND OF THE INVENTION

1. Field of the Invention

The present invention relates to a steel wire material for a spring wherein ferrite decarburized layer is not substantially present and workability is excellent, and its producing method.

The present invention further relates to steel for spring (spring steel) useful as a material for a coil spring used in a heat treated (quenched and tempered) condition, and more specifically, to a steel wire material for a spring excellent in corrosion fatigue property.

2. Description of the Related Art

In the steel wire material for a spring which requires high fatigue strength, high alloying is generally directed, and in addition, much Si is added to improve yield strength ratio of an element wire for the spring after quenching and tempering. However, because addition of a large amount of Si narrows the austenitic zone in the phase equilibrium diagram, ferrite decarburization is liable to occur.

To inhibit ferrite decarburization with austenitic zone being widened, alloy elements such as Ni, Cu, Mn may be added. However, only adding of these alloy elements enhances hardenability of the wire material too much and the metastable structure such as bainite and martensite is liable to be generated in the cooling process after hot rolling. This metastable structure exerts bad influence upon wire drawing (especially upon large diameter wire material) and causes cuppy break or transverse crack fracture.

In this connection, a variety of technologies have been proposed for preventing ferrite decarburization while maintaining excellent workability. For example, the Japanese Unexamined Patent Application Publication (JP-A) No. 2002-194432 discloses a technology for preventing ferrite decarburization by maintaining the steel temperature in the temperature range higher than the $A_3$ transformation point in all steps from the beginning to the end of hot rolling and the cooling speed after hot rolling is set at 0.5° C./s or faster, is disclosed. Further, the patent documents discloses the cooling speed should be 3.0° C./s or slower to lower the hardness of the wire material and to improve workability.

Also, in the JP-A-2007-009300, technology for preventing ferrite decarburization by performing rapid cooling in the temperature range of decarburization region between the $A_3$ transformation point and the $A_1$ transformation point (eutectoid transformation point) in the cooling process of the wire coil is disclosed. The patent document further discloses a technology for enhancing workability of the wire material at ordinary temperature by promoting pearlite transformation by performing slow cooling after the rapid cooling.

For the coil springs used for an automobile and the like, weight reduction is required for exhaust gas reduction and fuel economy improvement, and increase in the strength is directed as a part of it. In the spring with increased strength (the spring with the tensile strength after quenching and tempering is, for example, 1,900 MPa or more), early breakage by hydrogen embrittlement and corrosion fatigue generally becomes a problem.

To solve such problems, a variety of technologies have been conventionally proposed. For example, although Cr is generally known as an element for enhancing anti-corrosion property, the JP-A-2002-047539 discloses that the tensile test under a low distortion speed after a saline water spraying cycle test shows that addition of Cr inversely may reduce anti-corrosion property and Cu and Ni are effective to enhance anti-corrosion property in such case, and proposes to make the total amount of Cu and Ni to be two times or more of Cr.

The JP-A-2004-010965 teaches that C is to be decreased with the reason that C causes lowering of corrosion fatigue strength, deterioration of settling resistance which is worried due to decrease of C is to be prevented by adding Si, Cu, Ni, and etc., and Cu and Ni are effective in enhancing anti-corrosion property as well.

However the technical level of the knowledge described in these two patent documents is not high enough and there is room for further improvement in corrosion fatigue strength. For example, according to those patent documents, Ni is recognized to simply be excellent in anti-corrosion property and detailed study on its detailed interactive mechanism as well as on merits and demerits are lacking. Elements other than Ni can be considered to be the same.

Although a variety of conventional technologies have been proposed as described above to prevent ferrite decarburization, those effects are insufficient. For example, in the EXAMPLE column of the JP-A-2002-194432, the ferrite decarburization depth is shown to have attained 0 mm, but Si content of the steel used then is 1.79 wt % which is comparatively little. Also, in the JP-A-2007-009300, the ferrite decarburization depth is shown to have attained 0 mm, but C content of the steel used then is 0.48 wt % which is comparatively much. When C content is much or Si content is little, because the ferrite band in the Continuous Cooling Transformation (CCT) curve becomes thin, ferrite decarburization is comparatively easy. As the applicable element series of the technologies described in the JP-A-2002-194432 and No. 2007-009300 are limited, further development in the preventing technology of ferrite decarburization is desirable.

OBJECT AND SUMMARY OF THE INVENTION

Accordingly, an object of the invention is to provide the method for producing the wire material for a spring capable of more highly inhibiting ferrite decarburization and improving workability, and the wire material for a spring obtainable by the method for producing.

Another object of the invention is to provide the method for producing the wire material for a spring capable of preventing ferrite decarburization even in hypo-eutectoid steel of high Si content and little C content and improving workability, as well as the wire material for a spring obtainable by the method for producing.

Still another object of the invention is to provide the wire material for a spring capable of improving corrosion fatigue strength (particularly corrosion fatigue strength after heat treatment) in a higher level.

After intensive investigations to achieve the above objects, the present inventors have found that what can be surely prevented by merely controlling the hot rolling condition considering simply the transformation point of steel as described in the JP-A-2002-194432 and etc. is decarburization of core part only, that is, decarburization may possibly further proceeds acceleratingly if only the transformation point of steel is considered because C content of the surface of steel becomes less than that of the core part during hot rolling. Then, a first aspect of the invention was completed as it was found that ferrite decarburization could be prevented to a higher degree if the rolling temperature condition, even if decarburization at the surface of steel proceeded and the surface became C=0 wt %, was set avoiding the ferrite region under the state.

The first aspect of the invention resides in a steel wire material for a spring containing 0.37-0.54% C (in mass %, hereafter the same), 1.7-2.30% Si, 0.1-1.30% Mn, 0.15-1.1% Cr, 0.15-0.6% Cu, 0.010-0.1% Ti, 0.003-0.05% Al, and the balance including iron with inevitable impurities, wherein; the depth of ferrite decarburized layer is 0.01 mm or less, the depth of whole decarburized layer is 0.20 mm or less, and fracture reduction of area is 25% or more.

The steel wire material for a spring described above may contain suitable combination of either one of 0.15-0.7% Ni, 0.07-0.4% V and 0.01-0.1% Nb, and 0.01-0.3% Mo.

The steel wire material for a spring described above preferably contains 0.020% or less P, 0.020% or less S, 0.0070% or less N, and 0.0015% or less 0.

The method for producing the steel wire material for a spring described above includes the successive steps of hot rolling, coiling, and cooling on a cooling bed of the steel, wherein; when $A_1$ transformation point, $A_3$ transformation point, and $A_4$ transformation point at the time C=0 wt % in the phase equilibrium diagram of the steel are designated respectively as $A_{1(c=0)}$ transformation point, $A_{3(c=0)}$ transformation point, $A_{4(c=0)}$ transformation point, the heating temperature of the steel before hot rolling is 900° C. or higher and $A_{4(c=0)}$ transformation point or less, the maximum reaching temperature of the steel during finish rolling of hot rolling is $A_{3(c=0)}$ transformation point or higher and $A_{4(c=0)}$ transformation point or less, the placing temperature of the coil onto the cooling bed is $A_{1(c=0)}$ transformation point or higher and $A_{1(c=0)}$ transformation point+50° C. or lower, and cooling is performed in the temperature range where ferrite precipitates on the continuous cooling curve corresponding to 8.0-11 crystal grain size number of austenite grains at the cooling speed of 1.0° C./s or faster at the close parts of the coil and 8° C./s or slower at the rough parts of the coil.

The method for producing the steel wire material for a spring described above with the temperature conditions being more specifically established includes the successive steps of hot rolling, coiling, and cooling on a cooling bed of the steel, wherein; the heating temperature of the steel before hot rolling is 900° C. or higher and 1,250° C. or lower, the maximum reaching temperature of the steel during finish rolling of hot rolling is 1,050° C. or higher and 1,200° C. or lower, the placing temperature of the coil onto the cooling bed is 900° C. or higher and 980° C. or lower, and cooling is performed in the temperature range of the temperature 750° C.-600° C. at the cooling speed of 1.0° C./s or faster at the close parts of the coil and 8° C./s or slower at the rough parts of the coil.

In the method for producing the steel wire material for a spring described above, the maximum reaching temperature of the steel during finish rolling may be controlled into the range by working heat generation of the steel in hot rolling without performing water cooling before finish rolling.

In the method for producing the steel wire material for a spring described above, the ideal critical diameter DCI of the steel as exhibited in the equation (1) below exemplarily is 75-135 mm.

$$DCI(\text{mm})=25.4\times(0.171+0.001[C]+0.265[C]^2)\times(3.3333[Mn]+1)\times(1+0.7[Si])\times(1+0.363[Ni])\times(1+2.16[Cr])\times(1+0.365[Cu])\times(1+1.73[V])\times(1+3[Mo]) \quad (1)$$

(In the above equation, [ ] shows the content (mass %) of each element in steel.)

In this specification, $A_1$ transformation point, $A_3$ transformation point, and $A_4$ transformation point at the time C=0 wt % in the phase equilibrium diagram of steel are designated respectively as $A_{1(c=0)}$ transformation point, $A_{3(c=0)}$ transformation point, $A_{4(c=0)}$ transformation point. The equilibrium diagram can be drawn utilizing, for example, Thermo-Calc (by selecting four phases of BCC-$A_2$, FCC-$A_1$, LIQUID, CEMENTITE).

According to the first aspect of the invention, because the rolling condition is set assuming the condition of C=0 mass % which may possibly occur in the surface of the steel, ferrite decarburization can be more highly inhibited and workability can be enhanced.

Also, after intensive investigations to achieve the above objects, the present inventors found that, for improving the corrosion fatigue strength, improvement in three points of strength (hardness), shape of corrosion pits and hydrogen embrittlement resistance of steel, while ferrite decarburization was inhibited, was necessary, and furthermore, complicated influence of a variety of elements on these three points was clarified and a second aspect of the invention was completed.

The second aspect of the invention resides in a steel wire material for a spring containing 0.38-0.47% C, 1.9-2.5% Si, 0.6-1.3% Mn, 0.05-0.15% Ti, and 0.003-0.1% Al, the balance including iron with inevitable impurities, wherein; the depth of ferrite decarburized layer is 0.01 mm or less, Ceq1 as exhibited in the equation (1) below is 0.580 or more, Ceq2 as exhibited in the equation (2) below is 0.49 or less, and Ceq3 as exhibited in the equation (3) below is 0.570 or less.

$$Ceq1=[C]+0.11[Si]-0.07[Mn]-0.05[Ni]+0.02[Cr] \quad (1)$$

$$Ceq2=[C]+0.30[Cr]-0.15[Ni]-0.70[Cu] \quad (2)$$

$$Ceq3=[C]-0.04[Si]+0.24[Mn]+0.10[Ni]+0.20[Cr]-0.89[Ti]-1.92[Nb] \quad (3)$$

(In the above equation, [ ] shows the content (mass %) of each element in steel.)

The steel wire material for a spring described above may further contain, with response to necessity, 0.1-0.4% Cr, 0.1-0.7% Cu, 0.1-0.7% Ni, or 0.01-0.1% Nb.

In the steel wire material for a spring described above, 0.02% or less P, 0.02% or less S, 0.007% or less N, and 0.0015% or less O are preferable.

In the steel wire material for a spring described above, after performing the corrosion test described below, out of corrosion pits observed on the surface of the test piece, five or more corrosion pits are selected starting from one with a greater amount of depth, and the average of aspect ratios as exhibited in the equation (4) below of those corrosion pits preferably is 0.9 or less.

$$\text{Aspect ratio}=(\text{corrosion pit depth}\times 2)/(\text{corrosion pit width}) \quad (4)$$

Corrosion Test:

After the steel wire material for a spring is heated at a temperature of 925° C. for 10 minutes, it is cooled and oil quenched by the oil of a temperature of 70° C., then, after tempering by heating at 400° C. for 60 minutes, the test piece for a corrosion test is fabricated with the surface being polished with #800 emery paper.

5 wt % NaCl aqueous solution is sprayed to this test piece at 35° C. for 8 hours in accordance with JIS Z 2371, then, letting the treatment of the test piece being kept in the wet environment of 60% humidity and a temperature of 35° C. for 16 hours be one cycle, 14 cycles total are carried out.

After that, the rust is removed and then the corrosion pits on the surface of the test piece are observed by a laser microscope.

According to the second aspect of the invention, because a variety of alloy elements are appropriately controlled while ferrite decarburization is inhibited, hardness of the steel after heat treatment (quenching and tempering) can be improved, the shape of corrosion pits can be flattened, and resistance against hydrogen embrittlement can be improved, with the result that excellent corrosion fatigue strength can be realized. In addition, the steel wire material for a spring according to the present invention saves alloy elements and is excellent in economy as well.

DETAILED DESCRIPTION OF THE PREFERRED EMBODIMENTS

Figure 1:
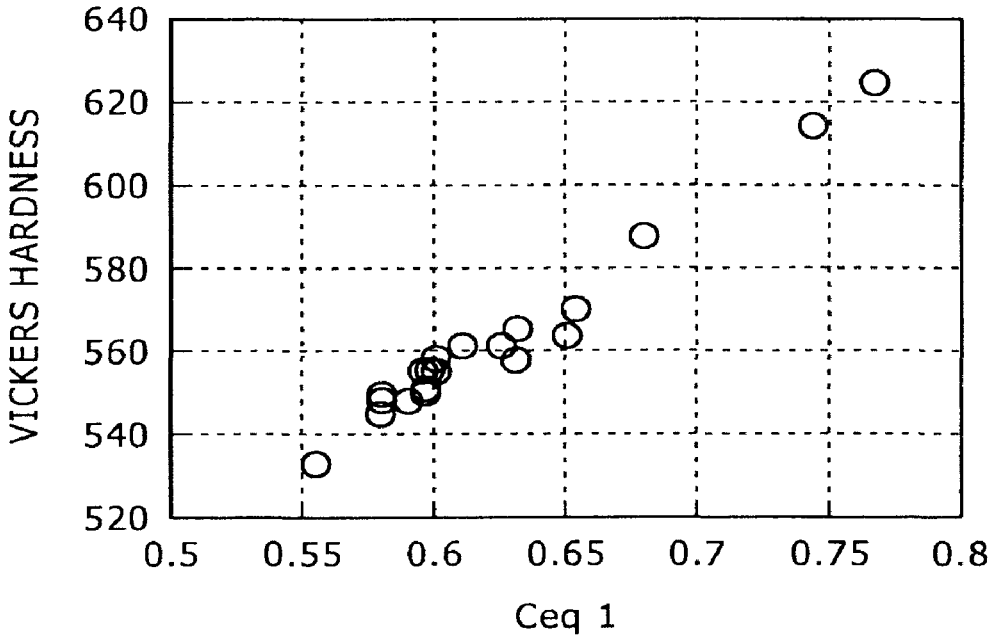
FIG. 1 is a graph showing the relationship between the Vickers hardness measured in Example 2 and Ceq1.

A first embodiment is described.

After intensive investigations, the present inventors found that the steel wire material for a spring which inhibited ferrite decarburization and was excellent in workability could be produced by appropriately controlling the production condition. Below, the production conditions of the first embodiment (hereinafter referred to simply as "the invention") will be described first and the chemical element composition of the steel will be described thereafter.

The embodiment of the invention is most characterized in establishing the rolling condition assuming the state of C=0 wt %. Decarburization on the surface of steel can be more highly inhibited by rolling under the condition wherein ferrite decarburization hardly occurs even in the state of C=0 wt %.

More specifically, during rolling, even if the steel is kept in a temperature equal to or higher than the $A_3$ transformation point calculated by the amount of the whole elements and carbon diffusion in the steel by phase transformation is inhibited, the carbon density on the surface of the steel gradually lowers. In the case of hypo-eutictoid steel, the $A_3$ transformation point goes up if C amount decreases. On the other hand, the rolling temperature (steel temperature) gradually lowers in the rough rolling and the intermediate rolling processes particularly. If the gradually lowering rolling temperature becomes the gradually rising $A_3$ transformation point or lower of the steel surface, phase transformation occurs on the surface of the steel and ferrite decarburization by carbon diffusion proceeds rapidly. In this connection, in the invention, production method has been improved so that ferrite decarburized layer does not remain in the wire material finally obtained even in the case such ferrite decarburization proceeds.

That is, under the method for producing in accordance with the invention, the maximum reaching temperature of the steel in the last rolling (finish rolling) performed after the rough rolling and the intermediate rolling is set at $A_{3(c=0)}$ transformation point or higher (preferably $A_{3(c=0)}$ transformation point+50° C. or higher, and more preferably $A_{3(c=0)}$ transformation point+70° C. or higher) and $A_{4(c=0)}$ transformation point or lower (preferably $A_{4(c=0)}$ transformation point−50° C. or lower, and more preferably $A_{4(c=0)}$ transformation point−100° C. or lower). If the steel is heated to the $A_{3(c=0)}$ transformation or higher in the finish rolling, even if the temperature before then (for example, in the intermediate rolling process after the rough rolling) becomes the $A_{3(c=0)}$ transformation point or lower and ferrite decarburization occurs, ferrite decarburized layer can be eliminated by back-diffusion of C. The reason the upper limit of the maximum reaching temperature is set at $A_{4(c=0)}$ transformation point or lower is that, if the temperature exceeds this point, δ-ferrite is generated on the surface of the steel and, on the contrary, ferrite decarburization proceeds. Another reason is that, if the temperature becomes $A_{4(c=0)}$ transformation point or higher, it becomes extremely high temperature and total decarburization (whole decarburization) proceeds as well.

In the meantime, the JP-A-2002-194432 discloses "ferrite decarburization occurs because ferrite transformation occurs in austenitic structure in a two phase region temperature" and therefore "steel should be kept at $A_3$ transformation point or higher during hot rolling to avoid a two phase region temperature and inhibit occurrence of ferrite decarburization". However, the JP-A-2002-194432 does not disclose nor suggest on how ferrite decarburized layer generated because the temperature lowers once to the $A_3$ transformation point or lower is to be eliminated and on how the transformation point on the surface of the steel at which carbon density possibly becomes 0 wt % is to be reflected to the production conditions.

The maximum reaching temperature of the steel during the finish rolling specifically is, for example, 1,050° C. or higher (preferably 1,100° C. or higher) and 1,200° C. or lower (preferably 1,150° C. or lower). This temperature is higher than the ordinary finish rolling temperature.

Although the method for making the finish rolling temperature to the region is not particularly limited, the temperature of the steel may be raised by omitting the water cooling ordinarily performed before the finish rolling (inclusive of attenuating the water cooling) and utilizing working heat generation at the time of the finish rolling.

The rolling temperature immediately before the finish rolling (for example, the final temperature of the intermediate rolling) is not particularly limited and, as described above, may be $A_{3(c=0)}$ transformation point or lower (preferably $A_{3(c=0)}$ transformation point−50° C. or lower, and more preferably $A_{3(c=0)}$ transformation point−100° C. or lower. Or alternatively it may be 1,000° C. or lower, preferably 950° C. or lower, and more preferably 930° C. or lower). Even if ferrite decarburization proceeds on the surface of the steel when the temperature becomes $A_{3(c=0)}$ transformation point or lower, this ferrite decarburization can be eliminated in the finish rolling. The rolling temperature before the finish rolling is, in general, 850° C. or higher, preferably 860° C. or higher, and more preferably 870° C. or higher.

Further, in the method for producing in accordance with the invention, the conditions before and after the hot rolling (heating condition, cooling condition after coiling) are as below.

The heating temperature of the steel before the hot rolling is 900° C. or higher (preferably 1,000° C. or higher, and more preferably 1,100° C. or higher) and $A_{4\ (c=0)}$ transformation point or less (preferably 1,250° C. or lower, and more preferably 1,200° C. or lower). The heating temperature particularly preferably is $A_{3(c=0)}$ transformation point or higher. If the heating temperature is too low, the productivity of the hot rolling is lowered. Also, the residence time in a ferritic-austenitic region becomes long. On the other hand, if the heating temperature exceeds $A_{4(c=0)}$ transformation point, ferrite decarburization attributable to δ-ferrite transforming and whole decarburization attributable to high temperature heating proceed.

What is important among the conditions after the hot rolling (after the finish rolling) is the cooling condition after coiling. The finish rolled wire material is cooled on the cooling bed after coiling, and this cooling condition has a great influence on the depth of the decarburized layer and workability of the wire material.

The cooling starting temperature can be set as the placing temperature of the coil (ring-shaped wire material) onto the cooling bed. This placing temperature is $A_{1(c=0)}$ transformation point or higher (preferably $A_{1(c=0)}$ transformation point+5° C. or higher, and more preferably $A_{1(c=0)}$ transformation point+10° C. or higher. Or 900° C. or higher, preferably 920° C. or higher, and more preferably 925° C. or higher) and $A_{4(c=0)}$ transformation point+50° C. or lower (preferably $A_{1(c=0)}$ transformation point+45° C. or lower, and more preferably $A_{1(c=0)}$ transformation point+40° C. or lower. Or alternatively, it is 980° C. or lower, preferably 975° C. or lower, and more preferably 970° C. or lower). If the placing temperature is too low, the residence time in a ferritic single phase region becomes long and ferrite decarburization and whole decarburization become liable to occur. On the contrary, if the placing temperature is too high, austenitic crystal grain is coarsened (austenitic crystal grain size number becomes, for example, less than 8.0) and the pearlite nose in CCT diagram retracts. As a result, in cooling after placing, supercooled structure (bainite and martensite) becomes liable to be generated and workability of the wire material is deteriorated. Further, if the crystal grains are coarsened, because crystal grain boundary (grain boundary triple point) which becomes nuclei of pearlitic transformation decreases and the pearlitic transformation starting temperature lowers, ferrite is liable to increase, and control of ferrite decarburization possibly becomes difficult.

In the cooling bed, it is important to control the cooling speed separately on the close parts of the wire coil (both ends in the width direction of the cooling conveyor) and on the rough parts of the wire coil (center in the width direction of the cooling conveyor). In the close parts of the coil, the cooling speed is liable to become slow compared with that in the rough parts, and if this cooling speed becomes excessively slow, decarburization (ferrite decarburization, in particular) occurs. Accordingly, the cooling speed of the close parts of the coil is set at 1.0° C./s or faster, preferably 1.3° C./s or faster, and more preferably 1.5° C./s or faster. On the other hand, the cooling speed in the rough parts of the coil is liable to become faster than that in the close parts, and if this cooling speed becomes excessively fast, the supercooled structure becomes liable to be generated. Accordingly, the cooling speed in the rough parts is set at 8° C./s or slower, preferably 7° C./s or slower.

Control of the cooling speed is appropriately performed with the CCT curve being taken into consideration. According to an embodiment of the invention, because austenitic crystal grain size number of the steel at the stage placed onto the cooling bed is made preferably to approximately 8.0-11, the cooling speed is controlled considering the CCT curve corresponding to this grain size number. In other words, in the invention, in the CCT curve, the cooling speed is controlled so that the cooling speed in the temperature range where ferrite deposits (for example, between the ferrite depositing starting temperature (Fs) and the pearlite depositing starting temperature (Ps)) becomes within the range described above. Also, the cooling speed is controlled so that, even if any CCT curve of 8.0-11 austenitic grain size numbers is used for assessing, the cooling speed becomes within the range described above.

The temperature range where the cooling speed is controlled may be set by concrete numeric value range, and the controlling temperature range is, for example, 750-600° C.

The cooling speed of the close parts and the rough parts of the coil can be separately controlled by, for example, adjusting the air volume striking the respective location.

The condition after finish rolling to coiling is designed so that the wire material after coiling can be fed onto the cooling bed as it is at a predetermined temperature. Ordinarily, after the finish rolling, coiling is performed after rapid cooling to a predetermined temperature by water cooling or air cooling (preferably by water cooling). By rapid cooling, the start of ferrite decarburization before the start of cooling at the cooling bed can be prevented.

According to the method for producing, ferrite decarburization can more highly be inhibited and workability can be enhanced. Accordingly, ferrite decarburization can be prevented even in the steel such as the one with high Si amount and low C amount in which ferrite decarburization is liable to occur.

The composition of the steel capable of improving workability while inhibiting ferrite decarburization by the method for producing is as below.

C: 0.37-0.54%
Si: 1.7-2.30%
Mn: 0.1-1.30%
Cr: 0.15-1.1%
Cu: 0.15-0.6%
Ti: 0.010-0.1%
Al: 0.003-0.05%
Balance: Iron and Inevitable Impurities The reasons of limiting the content are described below in detail.

C: 0.37-0.54%

If C amount is excessive, hardenability is increased too much, the supercooled structure is generated in the cooling process after rolling, and workability of the wire material is deteriorated, therefore C amount is made 0.54% or less. Further, by adopting the method for producing in accordance with the invention, ferrite decarburization can be prevented even if C amount further decreases. Also, it is advantageous that, the less C amount is, the more workability can be improved. Accordingly, the preferable C amount is 0.48% or less, particularly 0.42% or less. On the other hand, if C decreases excessively, ferrite depositing region increases and prevention of ferrite decarburization becomes difficult. Further, the strength (hardness) after quenching and tempering lowers. Accordingly, C amount is set at 0.37% or more (preferably 0.38% or more).

Si: 1.7-2.30%

Because Si, as a solid solution strengthening element, contributes for improving the strength (for example, improving the matrix strength) and improves proof stress, Si amount is made 1.7% or more. Also, by adopting the method for producing in accordance with the invention, ferrite decarburization can be prevented even if Si is increased further. Consequently, according to an embodiment of the invention, the lower limit of Si amount can be set high, it is possible to set also, for example, at 1.75% or more, and, particularly, it is an advantage of the invention that ferrite decarburization can be prevented even if Si amount is 1.9% or more (2.0% or more, for example). However if Si amount is excessive, ferrite depositing region increases and prevention of ferrite decarburization becomes difficult. Therefore, Si amount is set at 2.30% or less. The Si amount may preferably be set at 2.1% or less, and more preferably 1.9% or less.

Mn: 0.1-1.30%

Mn is the element effective for improving hardenability of steel and securing the hardness after quenching and tempering. If Mn amount is too little, it is difficult to achieve the hardenability required for the wire material for a spring. On the contrary, if Mn amount is excessive, the supercooled structure is generated in cooling after rolling and workability of the wire material is deteriorated. Therefore, Mn amount is set at 0.1% or more (preferably 0.12% or more, and more preferably 0.2% or more) and 1.30% or less (preferably 1.0% or less, more preferably 0.9% or less, and further more preferably 0.8% or less).

Cr: 0.15-1.1%

Cr is the element for strengthening the matrix of steel by solid solution strengthening and for improving hardenability. If Cr amount is too little, it is difficult to achieve the hardenability required for the wire material for a spring. On the contrary, if Cr amount is excessive, workability of the wire material is deteriorated. Therefore, Cr amount is set at 0.15% or more (preferably 0.2% or more, more preferably 0.5% or more, and 1.0% or more in particular) and 1.1% or less (preferably 1.05% or less).

Cu: 0.15-0.6%

Cu has the action of enhancing corrosion resistance of steel, and is the element inhibiting ferrite decarburization at the time of the heat treatment in hot rolling and spring working. However, if Cu amount becomes excessive, the hot crack possibly occurs. Therefore, Cu amount is set at 0.15% or more (preferably 0.20% or more) and 0.6% or less (preferably 0.5% or less).

Ti: 0.010-0.1%

Ti is the element effective for refining the old austenite grains after quenching and tempering and improving durability in the air and hydrogen embrittlement resistance. Also, Ti is effective for preventing generation of the supercooled structure in cooling after placing with Ti carbide being formed and with coarsening of austenite grains being prevented at the time of placing. However, if Ti amount is excessive, coarse Ti nitride deposits and workability is deteriorated. Therefore, Ti amount is set at 0.010% or more (preferably 0.020% or more) and 0.1% or less (preferably 0.09% or less).

Al: 0.003-0.05%

Al is the element acting as a deoxidizer at the time of molten steel treatment. Also, Al has a function to form fine Al nitride and, by its pinning effect, to refine crystal grains. However, if Al amount is excessive, a coarse Al oxide is formed, and fatigue characteristic or the like is affected adversely. Therefore, Al amount is set at 0.003% or more (preferably 0.005% or more) and 0.05% or less (preferably 0.03% or less).

The fundamental element composition of the steel used in the invention (and the steel wire material for a spring obtained thereby) is as described above and the balance essentially is iron. However, inclusion of inevitable impurities brought in by the situation of materials such as an iron raw material (inclusive of scrap) and an auxiliary raw material and production equipment and the like into the steel (the wire material) is rightfully allowed. These inevitable impurities may be strictly controlled and, for example, P, S, O, N and etc. may be controlled to the range described below.

P: 0.020% or less

P is the element which segregates in the old austenite grain boundary to embrittle the grain boundary and deteriorates fatigue characteristic. Therefore, P amount is preferred to be as little as possible and may be controlled to, for example, 0.020% or less (preferably 0.010% or less).

S: 0.020% or less

S is the element which segregates in the old austenite grain boundary to embrittle the grain boundary and deteriorates fatigue characteristic. Therefore, S amount is preferred to be as little as possible and may be controlled to, for example, 0.020% or less (preferably 0.010% or less).

N: 0.0070% or less

As N amount increases, a coarse nitride is formed with Ti or Al, and fatigue characteristic or the like is affected adversely. Therefore, N amount is preferred to be as little as possible and may be controlled to, for example, 0.0070% or less (preferably 0.005% or less). On the other hand, if N amount excessively decreases, productivity lowers considerably. Further, N forms nitride with Ti and Al and contributes to refining of the crystal grains. From this viewpoint, N amount is preferably to be set at 0.001% or more (preferably 0.002% or more).

O: 0.0015% or less

If O amount becomes excessive, a coarse oxide-based inclusion ($Al_2O_3$ and the like) is formed and fatigue characteristic or the like is affected adversely. Therefore, the upper limit of O amount was set at 0.0015% or less (preferably 0.0010% or less). On the other hand, the lower limit of O amount on industrial production generally is 0.0002% or more (preferably 0.0004% or more).

In addition, the steel in accordance with the invention may include the selective elements described below if necessary.

Ni: 0.15-0.7%

Ni is the element having the action to inhibit ferrite decarburization before and during rolling, and having the action to enhance the toughness of the spring material after quenching and tempering. Therefore, it is recommended, if necessary, to contain Ni amount preferably of 0.15% or more (more preferably 0.2% or more). However, if Ni amount is excessive, the amount of retained austenite increases by quenching and tempering, and the tensile strength is lowered. Therefore, Ni amount in the case of being contained is set at 0.7% or less (preferably 0.65% or less, and more preferably 0.6% or less).

V: 0.07-0.4% and/or Nb: 0.01-0.1%

V and Nb are the elements which have the action to form a fine compound (V carbide, nitride, or a complex compound thereof, Nb carbide, nitride, sulfide, or a complex compound thereof) and to improve hydrogen embrittlement resistance and fatigue characteristic, and have the action as well to exert the crystal grain refining effect to enhance toughness and proof stress. In addition, V contributes to improving the settling resistance. Therefore, it is recommended, if necessary, to contain V amount preferably of 0.07% or more (more preferably 0.10% or more) and Nb amount preferably of 0.01% or more (more preferably 0.02% or more).

However, if V and Nb amount is excessive, the amount of carbide not solid-resolved in austenite at the heating time of quenching increases, and enough strength cannot be obtained. In addition to this harmful effect, if V amount is excessive, the spring hardness lowers due to increase of the amount of retained austenite, and ferrite decarburization during hot rolling is promoted. Furthermore, if Nb amount is excessive, a coarse Nb nitride is formed and fatigue breakage becomes liable to occur. Therefore, V amount in the case of being contained is set at 0.4% or less (preferably 0.3% or less), and Nb amount in the case of being contained is set at 0.1% or less (preferably 0.05% or less).

Mo: 0.01-0.3%

Mo is the element effective in securing hardenability and improving softening resistance to allow improving settling resistance. Therefore, it is recommendable to contain Mo amount preferably of 0.01% or more (more preferably 0.02% or more). However, if Mo amount becomes excessive, the supercooled structure is generated at the time of cooling after hot rolling and workability and ductility is deteriorated. Consequently, Mo amount in the case of being contained is set at 0.3% or less (preferably 0.2% or less).

B: 0.0003-0.005%

B is the element which prevents segregation of P in the grain boundary and is effective in improving hydrogen embrittlement, toughness and ductility. B may be contained in a wire material with response to necessity. Further, B, even of a small amount, improves hardenability without addition of large amounts of alloy elements. Accordingly, B suppresses precipitate of ferrite in the surface layer of a wire material which occurs during slow cooling after rolling, and secures hardness to a deep portion of a steel after quenching in manufacturing of a spring. Therefore, it is recommended to contain B amount preferably of 0.0003% or more (more preferably, 0.0005% or more). However, if B amount is excessive, the effect of preventing segregation of P in the grain boundary is saturated, since free B decreases because of generation of B compounds such as $Fe_{23}(CB)_6$. In addition, those B compounds functions as a start point of a fatigue breakage and deteriorates fatigue property because the B compounds are coarse in many cases. Therefore, B amount in the case of being contained is set at 0.005% or less (preferably, 0.004% or less).

In the steel used in the method in accordance with the invention (and the steel wire material for a spring in accordance with the invention), the ideal critical diameter DCI shown in the equation (1) described above may be made, for example, 75-135 mm, preferably 80-120 mm, and more preferably 85-110 mm. If DCI is made 75 mm or more, securing the spring strength becomes easy. Also, if DCI is made 130 mm or less, securing of workability becomes easy.

If the steel wire material for a spring is produced in accordance with the method of the invention using the steel described above, decarburization can be prevented and workability can be improved. More specifically, in accordance with the invention, the depth of ferrite decarburized layer of the wire material can be made, for example, essentially 0 mm (specifically 0.01 mm or less, preferably 0.00 mm), the depth of whole decarburization layer can be made, for example, 0.20 mm or less (preferably 0.18 mm or less, and more preferably 0.15 mm or less), and the fracture reduction of area can be made, for example, 25% or more (preferably 28% or more, and more preferably 30% or more). The tensile strength is, for example, 1,000 MPa or more (preferably approximately 1,100-1,500 MPa, and more preferably approximately 1,200-1,400 MPa).

Because the steel wire material for a spring in accordance with the invention is excellent also in workability even if ferrite decarburization is prevented, it can be used for drawing from large diameter even as rolled. The wire diameter of the steel wire material for a spring in accordance with the invention is, for example, 5-25 mm (preferably 7-23 mm, and more preferably 10-20 mm).

Next, a second embodiment is described.

The steel wire material in accordance with the second embodiment (hereinafter referred to simply as "the invention") is characterized in that ferrite decarburization is prevented but the hardness after heat treatment is high, the pit generated by corrosion is flat, and hydrogen embrittlement resistance is improved. Such steel is excellent in corrosion fatigue strength. Prevention of ferrite decarburization described above can be achieved by devising the production condition. The hardness after heat treatment, the shape of the corrosion pit and hydrogen embrittlement resistance can be achieved by appropriately controlling alloy elements with ferrite decarburization being prevented (that is, by appropriately setting Ceq1-3 described above). Explanation is hereby given below in order.

In the invention, ferrite decarburization is prevented by devising the production method. Ferrite decarburization can be decreased by controlling alloy elements also. In this case, however, because the amount of alloy elements added may increase and deteriorate economy and Ceq1-3 become hard to be compatibly controlled, ferrite decarburization is prevented by devising the production method.

The basic philosophy and the procedure of the production method of the second embodiment are same of those of the first embodiment. Therefore, in the explanation below, only the detailed conditions which are different from those of the first embodiment will be described.

The preferable temperature range for the finish rolling is 1,000 or higher (particularly 1,050 or higher) and 1,250° C. or lower (particularly 1,200° C. or lower).

The rolling temperature immediately before the finish rolling (for example, the final temperature of the intermediate rolling) is not particularly limited and is ordinarily 850° C. or higher (preferably 860° C. or higher).

The heating temperature of the steel before the hot rolling is 900° C. or higher (preferably $A_{3(c=0)}$ transformation point or higher) and $A_{4(c=0)}$ transformation point or lower (preferably 1,250° C. or lower).

The placing temperature onto the cooling bed is 900° C. or higher, preferably 940° C. or higher.

In the cooling bed, the cooling speed is controlled separately for the close parts of the coil and the rough parts of the coil in the temperature range of 600-750° C. The cooling speed of the close parts of the coil is set at 1.0° C./s or faster (preferably 1.2° C./s or faster). The cooling speed in the rough parts of the coil is set at 8° C./s or slower (preferably 7° C./s or slower).

The steel wire material for a spring in accordance with the invention is characterized in not only that ferrite decarburized layer is decreased but also that 1) the hardness after heat treatment (quenching and tempering) is high, 2) the pit generated by corrosion is flat, and 3) hydrogen embrittlement resistance is improved. With all these three features, in addition to prevention of ferrite decarburization, being possessed, corrosion fatigue strength can be strengthened. Furthermore, the maximum feature of the invention resides in that the complicated relationships of alloy elements affecting 1) hardness, 2) shape of pit, 3) hydrogen embrittlement resistance have been clearly clarified, and that the fact that they showed extremely high correlation with Ceq1, Ceq2, Ceq3 respectively (refer to FIGS. 1-3) has been found. As Ceq1 increases, the hardness increases. As Ceq2 decreases, the shape of pit is flattened. As Ceq3 decreases, hydrogen embrittlement resistance is improved.

Each of them advantageously effects in enhancing corrosion fatigue strength.

$$Ceq1=[C]+0.11[Si]-0.07[Mn]-0.05[Ni]+0.02[Cr] \quad (1)$$

$$Ceq2=[C]+0.30[Cr]-0.15[Ni]-0.70[Cu] \quad (2)$$

$$Ceq3=[C]-0.04[Si]+0.24[Mn]+0.10[Ni]+0.20[Cr]-0.89[Ti]-1.92[Nb] \quad (3)$$

As is recognized by the equations above, Ni, for example, effects corrosion fatigue strength disadvantageously from the viewpoints of Ceq1 (hardness) and Ceq3 (hydrogen embrittlement resistance), and effects corrosion fatigue strength advantageously from the viewpoint of Ceq2 (shape of pit). Similarly, other alloy elements relate complicatedly. According to an embodiment of the invention, corrosion fatigue strength can surely be improved, not by controlling each element respectively, but by totally controlling from the viewpoints of Ceq1-3.

The range of Ceq1 is 0.580 or more, preferably 0.59 or more, and more preferably 0.60 or more. Ceq2 is 0.49 or less, preferably 0.47 or less, and more preferably 0.45 or less, particularly 0.43 or less. Ceq3 is 0.570 or less, preferably 0.54 or less, and more preferably 0.52 or less.

The hardness of the steel wire material for a spring in accordance with the invention, for example, is 540 HV or harder (approximately 540-580 HV, for example). If converted to Rockwell hardness C scale and tensile strength, the hardness corresponds to approximately 52-54 HRC and approximately 1,900-2,000 MPa.

The shape of pit achieved by the steel wire material for a spring in accordance with the invention can be specified by aspect ratio obtained by carrying out the corrosion test described below, and the aspect ratio, for example, is approximately 0.9 or less (0.3-0.85, for example).

Corrosion Test:

(a) After the steel wire material for a spring is heated at the temperature of 925° C. for 10 minutes, it is cooled and oil quenched by the oil of the temperature of 70° C., then, after tempering by heating at the temperature of 400° C. for 60 minutes, (after that, if necessary, the surface is cut to reduce the diameter, and after it (after the diameter is shortened by approximately 0.25 mm, for example)), the test piece for a corrosion test is fabricated, with the surface being polished with #800 emery paper.

(b) 5 wt % NaCl aqueous solution is sprayed to this test piece at 35° C. for 8 hours in accordance with JIS Z 2371, then, letting the treatment of the test piece being kept in the wet environment of 60% humidity and a temperature of 35° C. for 16 hours be one cycle, 14 cycles total are carried out.

(c) The rust generated in the saline water spray test is removed by dipping the test piece at ordinary temperature in the solution of ammonium citrate (98.7%) diluted by distilled water to 10 wt %. Then, the corrosion pits on the surface of the test piece are observed by a laser microscope, five or more corrosion pits are selected out of the corrosion pits observed on the surface of the test piece in the order of a greater amount of depth, and the aspect ratios of the corrosion pits are calculated according to the equation (4) below.

$$\text{Aspect ratio}=(\text{corrosion pit depth}\times 2)/(\text{corrosion pit width}) \quad (4)$$

The life for hydrogen crack of the steel wire material for a spring in accordance with the invention, for example, is 720 seconds or longer (approximately 800-1,200 seconds, for example). The life for hydrogen crack can be obtained in a manner described below.

After the steel wire material for a spring is heated at the temperature of 925° C. for 10 minutes, it is cooled and oil quenched by the oil of the temperature of 70° C., then, tempered by heating at the temperature of 400° C. for 60 minutes, and the test piece is fabricated. With the stress of 1,400 MPa being applied by 4-point bending, the test piece is dipped in the mixed aqueous solution of sulfuric acid (0.5 mol/L) and potassium thiocyanate (0.01 mmol/L). The voltage of −700 mV which is inferior to the SCE electrode is applied by a potentiostat, and the time until hydrogen crack occurs is measured.

The corrosion fatigue strength of the steel wire material for a spring in accordance with the invention, for example, is 290 MPa or more (preferably approximately 300-400 MPa). The corrosion fatigue strength can be obtained, for example, in a manner described below.

Corrosion Fatigue Strength:

(a) After the steel wire material for a spring is heated at the temperature of 925° C. for 10 minutes, it is cooled and oil quenched by the oil of the temperature of 70° C., then, after performing tempering by heating at the temperature of 400° C. for 60 minutes, the test piece in accordance with JIS (test piece for fatigue test) is fabricated.

(b) The parallel section of the test piece for fatigue test is polished by #800 emery paper. After the chucking section of the test piece is protected with a film to prevent corrosion, 5 wt % NaCl aqueous solution is sprayed to this test piece at 35° C. for 8 hours in accordance with JIS Z 2371 Standards. Then, letting the treatment of the test piece being kept in the wet environment of 60% humidity and a temperature of 35° C. for 16 hours be one cycle, 14 cycles total are carried out, and thereafter, the fatigue test is performed in accordance with Ono method rotary bending fatigue test. Increasing the loading stress with an increment of 10 MPa, the fatigue test is performed using 5 test pieces for each loading stress, and the stress at which all of 5 test pieces do not break up to 10,000,000 revolutions is defined as the corrosion fatigue strength.

The element composition of the steel wire material for a spring to which the invention can be applied is as below.

C: 0.38-0.47%
Si: 1.9-2.5%
Mn: 0.6-1.3%
Ti: 0.05-0.15%, and
Al: 0.003-0.1%
Balance: Iron and inevitable impurities The reason of limiting the alloy element amount (content) is hereby described in detail.

C: 0.38-0.47%

C is indispensably contained in steel and contributes to improving the strength (hardness) after quenching and tempering. However, if C amount is excessive, stress concentration to corrosion pits increases due to increase of aspect ratio of corrosion pits, and hydrogen embrittlement resistance is deteriorated due to deterioration of ductility of the matrix in steel. As a result, if C amount is excessive, corrosion fatigue resistance property deteriorates. Therefore C amount is set at 0.38% or more (preferably 0.39% or more) and 0.47% or less (preferably 0.45% or less, more preferably 0.43% or less).

Si: 1.9-2.5%

Si contributes to improving the strength as a solid solution strengthening element and improves proof stress as well. Consequently, if Si amount is too little, matrix strength becomes insufficient. Further, Si also has an action to enhance hydrogen embrittlement resistance by shifting the carbide depositing temperature at the time of tempering to high temperature side to shift the temper embrittlement region to high temperature side. However, if Si amount is excessive, penetration of carbide during refining heating is restrained and the strength is lowered. Therefore, Si amount is set at 1.9% or more (preferably 1.95% or more) and 2.5% or less (preferably 2.3% or less, and more preferably 2.2% or less).

Mn: 0.6-1.3%

Mn is the element to broaden the austenite region in the equilibrium diagram (austenite former element) and is effective in restraining ferrite decarburization stably. However if Mn amount is excessive, ductility of the matrix in the steel lowers, hydrogen embrittlement resistance is deteriorated, and as a result, corrosion fatigue strength deteriorates. Therefore, Mn amount is set at 0.6% or more (preferably 0.65% or more, and more preferably 0.7% or more) and 1.3% or less (preferably 1.1% or less, more preferably 0.9% or less).

Ti: 0.05-0.15%

Ti is effective for refining the old austenite grains after quenching and tempering, and improving durability in the air and hydrogen embrittlement resistance. However, if Ti amount is excessive, coarse Ti nitride deposits and fatigue characteristic is deteriorated. Therefore, Ti amount is set at 0.05% or more (preferably 0.06% or more, and more preferably 0.07% or more) and 0.15% or less (preferably 0.1% or less, and more preferably 0.09% or less, particularly 0.085% or less).

Al: 0.003-0.1%

Al is the element acting as a deoxidizes at the time of molten steel treatment. Also, Al has a function to form fine Al nitride and, by its pinning effect, to refine crystal grains. However, if Al amount is excessive, a coarse Al oxide is formed, and fatigue characteristic is affected adversely. Therefore, Al amount is set at 0.003% or more (preferably 0.005% or more) and 0.1% or less (preferably 0.05% or less, and more preferably 0.03% or less).

Balance of the steel wire material for a spring used in the invention essentially is iron. However, inclusion of inevitable impurities brought in by the situation of materials such as an iron raw material (inclusive of scrap) and an auxiliary raw material and production equipment and the like into the steel is rightfully allowed. These inevitable impurities may be strictly controlled and, for example, P, S, O, N and etc. may be controlled to the range described below.

P: 0.02% or less

P is the element which segregates in the old austenite grain boundary to embrittle the grain boundary and deteriorates fatigue characteristic. Therefore, P amount is preferred to be as little as possible and may be controlled to, for example, 0.02% or less (preferably 0.01% or less).

S: 0.02% or less

S is the element which segregates in the old austenite grain boundary to embrittle the grain boundary and deteriorates fatigue characteristic. Therefore, S amount is preferred to be as little as possible and may be controlled to, for example, 0.02% or less (preferably 0.01% or less).

N: 0.007% or less

As N amount increases, a coarse nitride is formed with Ti or Al, and fatigue characteristic is affected adversely. Therefore, N amount is preferred to be as little as possible and may be controlled to, for example, 0.007% or less (preferably 0.005% or less). On the other hand, if N amount excessively decreases, productivity lowers considerably. Further, N forms nitride with Ti and Al and contributes to refining of the crystal grains. From this viewpoint, N amount is preferably to be set at 0.001% or more (preferably 0.002% or more).

O: 0.0015% or less

If O amount becomes excessive, a coarse oxide-based inclusion ($Al_2O_3$ and the like) is formed and fatigue characteristic is affected adversely. Therefore, the upper limit of O amount was set at 0.0015% or less (preferably 0.0010% or less). On the other hand, the lower limit of O amount on industrial production generally is 0.0002% or more (preferably 0.0004% or more).

In addition, the steel in accordance with the invention may include the selective elements described below if necessary.

Cr: 0.1-0.4%

Cr has actions of enhancing matrix of steel by solid solution strengthening and improving hardenability. To exert such functions, it is recommended to contain Cr in steel at the amount of preferably 0.1% or more (more preferably 0.15% or more, and further more preferably 0.20% or more). However, Cr has an action to reduce pH value of the bottom part of the corrosion pits and increase the aspect ratio of the corrosion pits (sharpening), and this affects corrosion fatigue property adversely. Therefore, in the prevention, the upper limit of Cr amount is set at 0.4% or less (preferably 0.3% or less, more preferably 0.25% or less).

Cu: 0.1-0.7%

Cu is the element electrochemically superior to iron and has an action to enhance corrosion resistance of steel. Also, Cu has an action to increase amorphous composition of the rust generated during corrosion and suppress thickening of Cl element, which is one of the causes of corrosion, in the bottom part of corrosion pits. By this action, the aspect ratio of the corrosion pit is limited, stress concentration is mitigated, and corrosion fatigue property is improved. To exert such actions, it is recommended to contain Cu in steel at the amount of preferably 0.1% or more (more preferably 0.15% or more, and further more preferably 0.22% or more). However, addition of Cu may possibly cause hot rolling crack. Therefore, in the invention, the upper limit of Cu amount is set at 0.7% or less (preferably 0.5% or less, and more preferably 0.4% or less, particularly 0.35% or less).

Ni: 0.1-0.7%

As is similar to Cu, Ni has an action to enhance corrosion resistance, and an action to increase the amorphous composition of the rust and to decrease the aspect ratio of corrosion pits. To exert such actions, it is recommended to contain Ni in steel by the amount of preferably 0.1% or more (more preferably 0.15% or more, and further more preferably 0.20% or more). However, Ni has an action to increase the retained austenite amount in the matrix after heat treatment (quenching and tempering) which results in lowering the hardness (tensile strength) after heat treatment. Also, hydrogen embrittlement resistance is deteriorated. Therefore, in the invention, the upper limit of Ni amount is set at 0.7% or less, preferably 0.5% or less, and more preferably 0.4% or less, particularly 0.35% or less.

The spring steel in accordance with the invention is allowed not to contain all of Cr, Cu and Ni described above, but preferably contains at least one kind out of Cr, Cu and Ni, more preferably either one kind of Cr and Ni, at the amount described above.

Nb: 0.01-0.1%

Nb is the element having an action to form a fine compound (Nb carbide, nitride, sulfide and a complex compound thereof) and improve hydrogen embrittlement resistance. Also, Nb has an action to exert the crystal grain refining effect and improve ductility and proof stress. Consequently, it is recommended to contain, if necessary, Nb at the amount of preferably 0.01% or more (more preferably 0.02% or more). However, if Nb amount is excessive, the amount of the carbide which is not solid-resolved into austenite at the time of heating for quenching increases, and it becomes impossible to obtain enough strength cannot be obtained. In addition, If Nb amount is excessive, a coarse Nb nitride is formed and fatigue breakage becomes liable to occur. Therefore, Nb amount in the case of being contained is set at 0.1% or less (preferably 0.05% or less).

B: 0.0003-0.005%

B is the element which prevents segregation of P in the grain boundary and is effective in improving hydrogen embrittlement, toughness and ductility. B may be contained in a wire material with response to necessity. Further, B, even of a small amount, improves hardenability without addition of large amounts of alloy elements. Accordingly, B suppresses precipitate of ferrite in the surface layer of a wire material which occurs during slow cooling after rolling, and secures hardness to a deep portion of a steel after quenching in manufacturing of a spring. Therefore, it is recommended to contain B amount preferably of 0.0003% or more (more preferably, 0.0005% or more). However, if B amount is excessive, the effect of preventing segregation of P in the grain boundary is saturated, since free B decreases because of generation of B compounds such as $Fe_{23}(CB)_6$. In addition, those B compounds functions as a start point of a fatigue breakage and deteriorates fatigue property because the B compounds are coarse in many cases. Therefore, B amount in the case of being contained is set at 0.005% or less (preferably, 0.004% or less).

The wire diameter of the spring steel in accordance with the invention, for example, is 9-25 mm (preferably 10-20 mm).

EXAMPLE

Although the present invention is described below in further detail by referring to the examples, the present invention is by no means to be limited by the examples below and can of course be implemented with appropriate modifications added within the scope adaptable to the purposes described above and below, and any of them is to be included within the technical range of the present invention.

Example 1

The example in relation with the first embodiment is described hereunder.

The steel with the chemical composition shown in Table 1 (steel kind: SA-SL) was molten by 80 ton converter, a 400 mm square bloom was made by continuous casting, and then it was bloomed to a 155 mm square billet. After the billet was heated it was hot-rolled, then, after water-cooled nearly to the placing temperature, it was coiled and placed onto a cooling bed (conveyor) of a Stelmor cooling device, and by being subjected to air-blast cooling with the air volume supplied to the close parts of the coil and the coarse parts of the coil being adjusted, 2 tons of wire material for a spring with a 14.3 mm diameter was produced. The detailed production conditions are as shown in Table 2. In the table 2, cooling speed is the speed between the temperatures of 750° C. and −600° C.

Tensile strength, fracture reduction of area, depth of decarburized layer of the steel obtained were measured as described below. Also, to confirm the austenite crystal grain number of the wire material before start of cooling, the test described below was performed.

(1) Tensile Test (Tensile Strength, Fracture Reduction of Area)

Each of the fifth windings from the top part (start of rolling) and the bottom part (end of rolling) of the wire coil was cut. Each of one winding of the top side and the bottom side was equally divided into eight respectively and 16 pieces total of wire fragments were made. After the wire fragments were made straight-shape by roller straightening, No. 2 test pieces (200 mm distance between chucks) of JIS Z 2201 were made from the respective wire fragments, the tensile tests were performed, and the tensile strength and the fracture reduction of area were measured. Among 16 test pieces, the maximum value of the tensile strength and the minimum value of the fracture reduction of area were made the tensile strength and the fracture reduction of area of the wire material concerned. The case with high tensile strength and low fracture reduction of area (less than 25%, in particular) was judged as the exhibition of influence of the supercooled structure and was rejected.

(2) Depth of Decarburized Layer

In the 16 pieces of wire fragments obtained from the top side and the bottom side, samples were taken by cutting approximately 10 mm in the vicinity of the location where the test piece for the tensile test had been taken. The samples were embedded in resin with the cut faces (transverse sections) coming out to the surface, were wet-ground using an emery paper and diamond particles, were etched by picral solution, and 16 total test pieces for measuring the depth of the decarburized layer were made. These test pieces were observed at an observation magnification of 200 times using an optical microscope to measure the depth of total decarburized layer and the depth of ferrite decarburized layer of the surface layer. The method of measurement was in accordance with the method of measurement by an optical microscope stipulated in JIS G 0558. Among 16 samples, the maximum value of the depth of total decarburized layer and the depth of ferrite decarburized layer were made "depth of total decarburized layer" and "depth of ferrite decarburized layer" in the present invention.

(3) Austenite Crystal Grain Size Number

Similarly to the exemplary test described above, the processes from melting of steel to coiling of wire were performed. The wire coil was cooled, not by the cooling condition as described in Table 2, but by strong wind cooling at the cooling speed of approximately 20° C./s to the temperature of 200° C., 2 tons of the wire material mainly of martensite structure (that is, the wire material in which 95 area % or more of the structure is martensite structure when the depth of 0.1 mm of the surface layer is observed at an observation magnification of 200 times using an optical microscope) was produced. Each of the fifth windings from the top part and the bottom part of the coil was cut, each of one windings of the top side and the bottom side was equally divided into eight respectively, and 16 pieces total of wire fragments were made. The samples of approximately 20 mm length were taken from each wire material fragment by wet cutting, and were subjected to annealing by 550° C.×2 hours. The samples were embedded in resin with the cut face (transverse section) coming out to the surface, were wet-ground using an emery paper and diamond particles, were etched by picral solution, and 16 total test pieces for measuring austenite crystal grain size number were made. These test pieces were observed by an optical microscope and the austenite crystal grain size numbers at the location 0.1 mm deep from the surface layer were measured. The method of measurement was in accordance the method of testing crystal grain size by an optical microscope stipulated in JIS G 0551. Among 16 samples, the minimum value of the austenite crystal grain size number was adopted.

The result of the measurement is shown in Table 2. In Table 2, $A_1$ transformation point, $A_1$ transformation point, and $A_4$ transformation point (they are, $A_{1(c=0)}$ transformation point, $A_{3(c=0)}$ transformation point, $A_{4(c=0)}$ transformation point) calculated by Thermo-Calc based on the chemical composition (but C=0%) were also shown. In the steel kind J, $A_3$ and $A_4$ curves join with each other in the vicinity of C=0%, and $A_{3(c=0)}$ transformation point and $A_{4(c=0)}$ transformation point disappeared.

TABLE 1

| STEEL | CHEMICAL COMPOSITION (Unit: Wt %, Balance: Iron and inevitable impurities) | | | | | | | | | | | | | | | |
|---|---|---|---|---|---|---|---|---|---|---|---|---|---|---|---|---|
| KIND | C | Si | Mn | Ni | Cr | V | Ti | Cu | Nb | P | S | Mo | B | Al | N | O |
| SA | 0.42 | 2.21 | 0.79 | — | 0.22 | — | 0.076 | 0.50 | — | 0.008 | 0.007 | — | — | 0.018 | 0.0033 | 0.0009 |
| SB | 0.42 | 2.19 | 0.78 | 0.19 | 0.21 | — | 0.074 | 0.28 | — | 0.005 | 0.004 | — | — | 0.025 | 0.0045 | 0.0011 |
| SC | 0.41 | 1.74 | 0.19 | 0.51 | 1.04 | 0.16 | 0.061 | 0.27 | — | 0.007 | 0.003 | — | — | 0.018 | 0.0020 | 0.0004 |
| SD | 0.43 | 1.89 | 0.16 | 0.58 | 1.01 | 0.11 | 0.060 | 0.36 | — | 0.008 | 0.003 | — | — | 0.031 | 0.0047 | 0.0010 |
| SE | 0.48 | 1.95 | 0.74 | 0.29 | 0.18 | 0.15 | 0.076 | 0.18 | — | 0.005 | 0.003 | — | — | 0.025 | 0.0033 | 0.0007 |
| SF | 0.42 | 2.00 | 1.25 | 0.33 | 0.21 | — | 0.055 | 0.54 | 0.021 | 0.006 | 0.005 | — | — | 0.004 | 0.0055 | 0.0005 |
| SG | 0.42 | 1.72 | 0.23 | — | 0.52 | — | 0.098 | 0.36 | — | 0.007 | 0.006 | 0.15 | — | 0.005 | 0.0025 | 0.0015 |
| SH | 0.36 | 2.08 | 0.88 | 0.68 | 0.16 | — | 0.050 | 0.58 | — | 0.005 | 0.004 | — | — | 0.020 | 0.0011 | 0.0005 |
| SI | 0.55 | 1.72 | 0.33 | 0.45 | 1.02 | 0.11 | 0.042 | 0.15 | 0.023 | 0.019 | 0.018 | — | — | 0.035 | 0.0024 | 0.0012 |
| SJ | 0.48 | 2.32 | 0.58 | 0.25 | 0.14 | — | 0.051 | 0.16 | — | 0.021 | 0.022 | — | — | 0.015 | 0.0041 | 0.0008 |
| SK | 0.41 | 1.75 | 1.32 | 0.51 | 0.28 | — | 0.066 | 0.25 | — | 0.012 | 0.014 | — | — | 0.020 | 0.0022 | 0.0008 |
| SL | 0.44 | 1.73 | 0.27 | — | 0.98 | 0.22 | 0.005 | 0.22 | — | 0.013 | 0.008 | — | — | 0.018 | 0.0072 | 0.0017 |
| SM | 0.42 | 2.21 | 0.79 | — | 0.22 | — | 0.076 | 0.50 | — | 0.008 | 0.007 | — | 0.0020 | 0.022 | 0.0035 | 0.0008 |

TABLE 2

| WIRE MATERIAL | STEEL KIND | TRANSFORMATION PONT WHEN C = 0% $A_1$ (° C.) | $A_3$ (° C.) | $A_4$ (° C.) | DCI (mm) | HEATING TEMP. (° C.) | MINIMUM ROLLING TEMP. (.) | MAXIMUM REACHING TEMP. DURING FINISH ROLLING (° C.) |
|---|---|---|---|---|---|---|---|---|
| SA-1 | SA | 950 | 1100 | 1250 | 89 | 1240 | 900 | 1150 |
| SA-2 | | | | | | 1150 | 880 | 1000 |
| SA-3 | | | | | | 1300 | 885 | 1080 |
| SB-1 | SB | 940 | 1080 | 1270 | 87 | 1210 | 910 | 1150 |
| SB-2 | | | | | | 1200 | 880 | 1280 |
| SB-3 | | | | | | 1190 | 940 | 1090 |
| SC-1 | SC | 925 | 1050 | 1250 | 107 | 1210 | 905 | 1180 |
| SC-2 | | | | | | 1200 | 880 | 1150 |
| SC-3 | | | | | | 1180 | 920 | 1040 |
| SD-1 | SD | 920 | 1050 | 1260 | 103 | 1180 | 910 | 1150 |
| SD-2 | | | | | | 1220 | 900 | 1160 |
| SD-3 | | | | | | 1240 | 880 | 1190 |
| SE-1 | SE | 925 | 1080 | 1270 | 100 | 1210 | 860 | 1150 |
| SE-2 | | | | | | 1280 | 880 | 1140 |
| SE-3 | | | | | | 1200 | 900 | 1090 |
| SF-1 | SF | 850 | 970 | 1360 | 134 | 1250 | 900 | 1150 |
| SF-2 | | | | | | 1200 | 1050 | 1370 |
| SF-3 | | | | | | 1180 | 880 | 1140 |
| SG-1 | SG | 1005 | 1140 | 1180 | 75 | 1170 | 900 | 1150 |
| SG-2 | | | | | | 1180 | 910 | 1160 |
| SG-3 | | | | | | 880 | 840 | 980 |
| SH-1 | SH | 860 | 980 | 1360 | 103 | 1200 | 880 | 1060 |
| SI-1 | SI | 925 | 1020 | 1280 | 138 | 1210 | 910 | 1180 |
| SJ-1 | SJ | 1000 | — | — | 62 | 1205 | 900 | 1150 |
| SK-1 | SK | 900 | 925 | 1390 | 137 | 1180 | 925 | 1120 |
| SL-1 | SL | 980 | 1110 | 1210 | 110 | 1200 | 960 | 1090 |
| SM-1 | SM | 950 | 1100 | 1250 | 125 | 1260 | 910 | 1160 |
| SM-2 | | | | | | 1100 | 890 | 980 |
| SM-2 | | | | | | 1320 | 890 | 1070 |

| WIRE MATERIAL | PLACING TEMPER-ATURE (° C.) | AUSTENAITE GRAIN SIZE NO. | COIL CLOSE PARTS COOLING SPEED (° C./S) | COIL COARSE PARTS COOLING SPEED (° C./S) | DmT (mm) | DmF (mm) | TENSILE STRENGTH (MPa) | RUPTURE REDUCTION OF AREA (%) |
|---|---|---|---|---|---|---|---|---|
| SA-1 | 965 | 9.8 | 1.8 | 6.9 | 0.15 | 0.00 | 1180 | 32 |
| SA-2 | 955 | 10.0 | 2.0 | 7.2 | 0.18 | 0.04 | 1210 | 30 |
| SA-3 | 950 | 10.5 | 2.2 | 7.8 | 0.35 | 0.06 | 1050 | 41 |
| SB-1 | 945 | 10.5 | 2.1 | 6.9 | 0.09 | 0.00 | 1210 | 31 |
| SB-2 | 950 | 9.8 | 1.5 | 4.5 | 0.21 | 0.03 | 1180 | 35 |
| SB-3 | 970 | 8.8 | 0.8 | 5.1 | 0.18 | 0.05 | 1220 | 28 |
| SC-1 | 970 | 9.0 | 1.5 | 5.5 | 0.08 | 0.00 | 1240 | 30 |
| SC-2 | 990 | 7.5 | 2.5 | 7.5 | 0.16 | 0.00 | 1390 | 21 |
| SC-3 | 954 | 9.8 | 1.5 | 5.2 | 0.18 | 0.02 | 1250 | 28 |
| SD-1 | 970 | 8.9 | 3.5 | 7.5 | 0.18 | 0.00 | 1280 | 28 |
| SD-2 | 890 | 10.5 | 3.2 | 6.2 | 0.29 | 0.05 | 1220 | 38 |
| SD-3 | 920 | 10.0 | 3.0 | 9.2 | 0.12 | 0.00 | 1380 | 16 |

TABLE 2-continued

| | | | | | | | | |
|---|---|---|---|---|---|---|---|---|
| SE-1 | 925 | 9.5 | 6.8 | 7.0 | 0.15 | 0.00 | 1320 | 32 |
| SE-2 | 930 | 9.9 | 1.5 | 3.8 | 0.28 | 0.05 | 1300 | 31 |
| SE-3 | 945 | 10.3 | 0.5 | 2.2 | 0.15 | 0.08 | 1280 | 35 |
| SF-1 | 940 | 10.0 | 1.8 | 7.8 | 0.08 | 0.00 | 1280 | 28 |
| SF-2 | 970 | 9.5 | 2.2 | 6.1 | 0.22 | 0.05 | 1310 | 25 |
| SF-3 | 905 | 10.5 | 1.5 | 8.5 | 0.12 | 0.00 | 1480 | 10 |
| SG-1 | 1020 | 10.0 | 6.6 | 7.8 | 0.15 | 0.00 | 1180 | 30 |
| SG-2 | 880 | 12.1 | 2.8 | 7.5 | 0.18 | 0.06 | 1120 | 33 |
| SG-3 | 910 | 10.8 | 2.2 | 6.4 | 0.38 | 0.12 | 1110 | 32 |
| SH-1 | 900 | 10.5 | 1.5 | 7.5 | 0.36 | 0.05 | 1200 | 38 |
| SI-1 | 930 | 10.0 | 3.2 | 6.6 | 0.15 | 0.00 | 1680 | 0 |
| SJ-1 | 960 | 10.2 | 3.0 | 5.4 | 0.44 | 0.08 | 1180 | 32 |
| SK-1 | 905 | 9.8 | 2.8 | 3.8 | 0.16 | 0.00 | 1480 | 2 |
| SL-1 | 970 | 7.8 | 5.0 | 7.2 | 0.19 | 0.05 | 1390 | 5 |
| SM-1 | 965 | 8.8 | 1.8 | 6.9 | 0.15 | 0.00 | 1250 | 27 |
| SM-2 | 955 | 9.0 | 2.0 | 7.2 | 0.18 | 0.02 | 1280 | 25 |
| SM-2 | 950 | 9.5 | 2.2 | 7.8 | 0.32 | 0.04 | 1090 | 35 |

DmT: Whole Decarburized Layer Depth
DmF: Ferrite Decarburized Layer Depth

In the wire materials SA-1, SB-1, SC-1, SD-1, SE-1, SF-1 and SG-1 which satisfy the requirements of the present invention, depth of ferrite decarburized layer is 0.00 mm and the value of fracture reduction of area is 25% or more.

On the other hand, in the wire materials SA-3 and SE-2 with high heating temperature, the wire materials SA-2, SC-3, SG-3 and SL-1 with low maximum reaching temperature during the finish rolling, the wire materials SB-2 and SF-2 with high maximum reaching temperature during the finish rolling, the wire materials SD-2 and SG-2 with low placing temperature, the wire materials SB-3 and SE-3 with low cooling speed of the close parts of the coil, and the wire materials SH-1 and SJ-1 with C and Si amount being out of the range of the present invention, ferrite decarburization occurs.

In the meantime, $A_3$ transformation point of steel A (C=0.42%), for example, is approximately 840° C., and in the case of SA-2, the temperature is maintained at the $A_3$ transformation point or higher all time during rolling. In the case of this SA-2, however, ferrite decarburization occurred. As is shown in SA-1, ferrite decarburization could be prevented by setting the maximum reaching temperature during the finish rolling at the $A_{3(c=0)}$ transformation point or higher.

Further, in the wire material C-2 with high placing temperature, the wire materials SD-3 and SF-3 with high cooling speed at the coarse parts of the coil, and the wire materials SI-1 and SK-1 with excessive amount of alloy elements, fracture reduction of area is as low as lower than 25%.

Example 2

The example in relation with the second embodiment is described hereunder.

The steel with the chemical composition shown in Table 3 was molten by a 150 kg small sized vacuum melting furnace, and a 155 mm square billet was made by hot forging. Ceq1-3 calculated from the chemical composition are shown in Table 5. After the billet was heated, it was hot-rolled, then, after water-cooled nearly to the placing temperature, it was coiled and placed onto the cooling bed (conveyor) of the Stelmor cooling device, and by being subjected to air-blast cooling with the air volume supplied to the close parts of the coil and the coarse parts of the coil being adjusted, the spring steel (wire material) with a 13.5 mm diameter was produced. The detailed production conditions are as shown in Table 4. In Table 4, cooling speed is the speed between the temperature of 600° C.-750° C. Further, in Table 4, $A_{1(c=0)}$ transformation point, $A_{3(c=0)}$ transformation point, and $A_{4(c=0)}$ transformation point) calculated by Thermo-Calc based on the chemical composition (but C=0%) were written.

Depth of decarburized layer, fatigue strength after heat treatment (quenching and tempering), Vickers hardness, aspect ratio of corrosion pits, and life for hydrogen embrittleness crack of the steel wire material for a spring obtained were measured as described below.

(1) Depth of Decarburized Layer

The third, forth and fifth windings from the bottom side (end of rolling) of the wire coil were cut, each one winding was equally divided into eight, and 24 pieces total of wire fragments were made. From the wire fragments, samples were taken by cutting respectively by approximately 10 mm. The samples were embedded in resin with the cut faces (transverse sections) coming out to the surface, were wet-ground using an emery paper and diamond particles, were etched thereafter by picral solution, and 24 pieces total of test pieces for measuring the depth of decarburized layer were made. These test pieces were observed at an observation magnification of 200 times using an optical microscope and, similarly to the case of EXAMPLE 1, the depth of total decarburized layer (DmT) and the depth of ferrite decarburized layer (DmF) were obtained.

(2) Fatigue Strength

The wire fragments were drawn (cold draw) and cut, and samples with 12.5 mm diameter×70 mm length were made. After the samples were heated at the temperature of 925 for 10 minutes, they were cooled and oil quenched by the oil of the temperature of 70° C., then, they were tempered by heating at the temperature of 400° C. for 60 minutes. The steel, after being quenched and tempered, was worked to make No. 1 test pieces (test pieces for fatigue test) of JIS Z 2274 with 12 mm chucking part diameter and 8 mm parallel part diameter.

The parallel part of the test pieces were polished with a #800 emery paper. After the chucking parts of the test pieces were protected with enamel film to prevent corrosion, 5 wt % NaCl aqueous solution was sprayed to these test pieces at 35° C. for 8 hours in accordance with JIS Z 2371, then, letting the treatment of the test pieces being kept in the wet environment of 60% humidity and a temperature of 35° C. for 16 hours be one cycle, 14 cycles total were carried out. The test pieces after the corrosion test were kept in a vacuum desiccator until they were used for Ono method rotary bending fatigue test. Increasing the loading stress with an increment of 10 MPa, One method rotary bending fatigue test was performed using 5 test pieces for each loading stress, and the stress at which all of 5 test pieces had not been broken up to 10,000,000 revolutions was defined as the corrosion fatigue strength. The result is shown in Table 5.

(3) Vickers Hardness

The wire fragments were cold drawn and cut, and samples with 12.5 mm diameter×60 mm length were made. The samples were quenched and tempered in the same conditions as those for the fatigue test, and the test pieces for measuring Vickers hardness were made. The test pieces were embedded in resin with the transverse section being exposed, were ground and mirror finished, then, Vickers hardness test was performed at the location 0.1 mm deep from the surface layer by 10 kg load, and Vickers hardness was measured. The result is shown in Table 5. In FIG. 1, a graph showing relationship between Vickers hardness and Ceq1 is entered. Also, in Table 5, the tensile strength converted from Vickers hardness is shown (shown as "Converted TS" in Table 5). For this conversion, the equation (5) below was applied:

$$TS=58.33\times(-9.751+0.16491\times HV-9.4457\times10^{-5}\times HV^2)-1135.7 \quad (5)$$

(In the above equation, TS represents tensile strength (MPa), and HV represents Vickers hardness.)

(4) Aspect Ratio of Corrosion Pits

Figure 2:
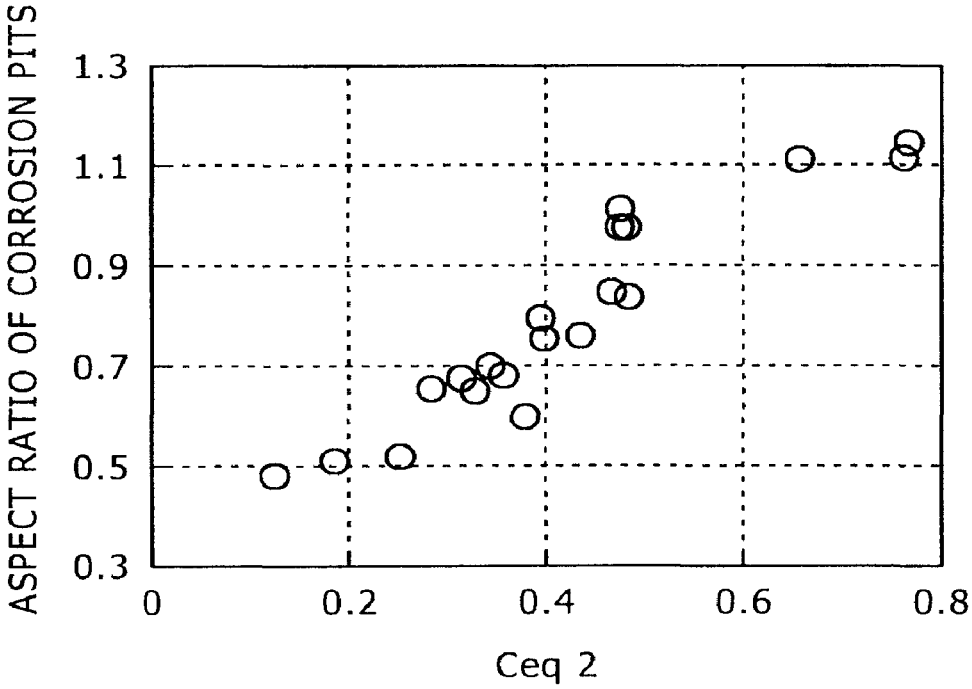
FIG. 2 is a graph showing the relationship between the aspect ratio of corrosion pits measured in Example 2 and Ceq2.

The wire fragments were cold drawn and cut, and samples with 12.5 mm diameter×120 mm length were made. After the samples were quenched and tempered in the same conditions as those for the fatigue test, they were machined to a shape of 10 mm diameter×100 mm length, and the test pieces for measuring aspect ratio were made. The surfaces of the test pieces were polished with a #800 emery paper. 10 mm of both ends of the test piece were protected with enamel film to prevent corrosion, NaCl aqueous solution of 5 wt % was sprayed to these test pieces at 35° C. for 8 hours in accordance with JIS Z 2371, then, letting the treatment of the test piece being kept in the wet environment of 60% humidity and a temperature of 35° C. for 16 hours be one cycle, 14 cycles total were carried out. The rust generated in the saline water spray test was then removed by dipping the test pieces at ordinary temperature in the solution of ammonium citrate (98.7%) diluted by distilled water to 10 wt %, and the corrosion pits on the surface of the test pieces were observed by a laser microscope ("1LM21W" made by Lasertec Corporation, magnification: 100-200 times). Five test pieces were used for each steel kind. Ten corrosion pits were selected, out of the corrosion pits observed on the surface of five test pieces, in the order of a greater amount of depth, the depth and the width of each corrosion pit were substituted to the equation (4) above to calculate aspect ratios, and the average values were obtained. The result is shown in Table 5. In FIG. 2, a graph showing the relationship between aspect ratio (average value) of corrosion pits and Ceq2 is entered.

(5) Life for Hydrogen Embrittlement Crack

Figure 3:
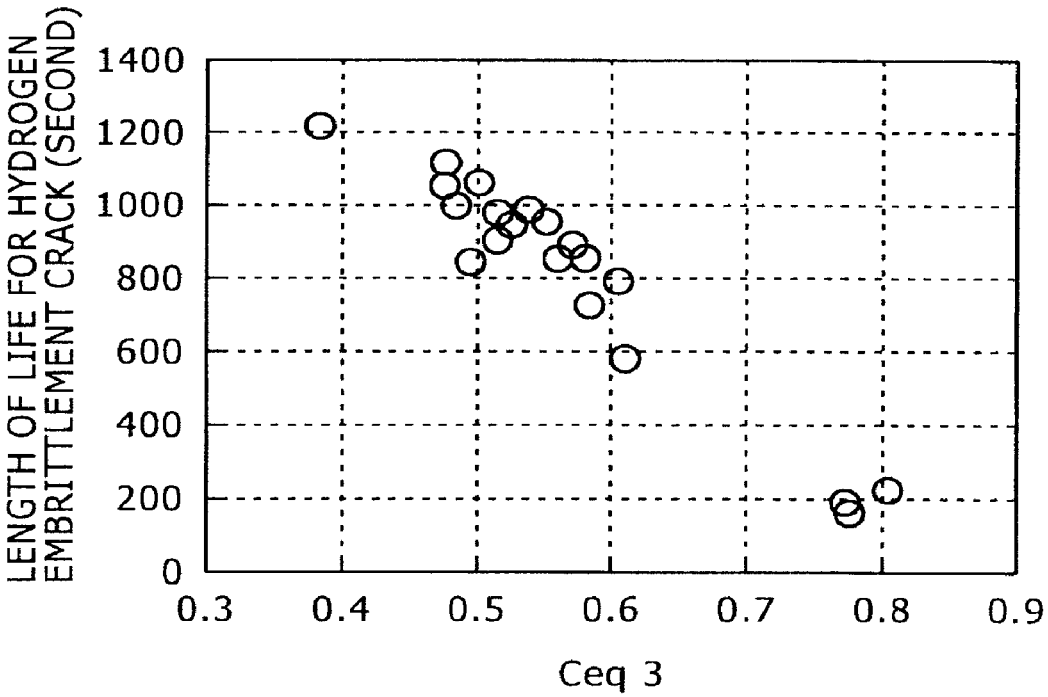
FIG. 3 is a graph showing the relationship between the length of life for hydrogen embrittlement crack measured in Example 2 and Ceq3.

The wire fragment were cold drawn and cut, and samples with 12.5 mm diameter×70 mm length were made. After the samples were quenched and tempered in the same conditions as those for the fatigue test, test pieces of 10 mm width×1.5 mm thickness X 65 mm length were cut out. With the stress of 1,400 MPa being applied to these test pieces by 4-point bending, the test pieces were dipped in the mixed aqueous solution of sulfuric acid (0.5 mol/L) and potassium thiocyanate (0.01 mmol/L). The voltage of −700 mV which is inferior to SCE electrode was applied by a potentiostat, and the time until crack occurred was measured. The result is shown in Table 5. In FIG. 3, a graph showing the relationship between life for hydrogen embrittlement crack and Ceq3 is entered.

TABLE 3

| STEEL KIND | C | Si | Mn | Cr | Cu | Ni | Ti | Nb | V | B | P | S | Al | N | O |
|---|---|---|---|---|---|---|---|---|---|---|---|---|---|---|---|
| A | 0.42 | 2.20 | 0.80 | — | 0.15 | 0.20 | 0.075 | — | — | — | 0.008 | 0.011 | 0.021 | 0.0055 | 0.0014 |
| B | 0.42 | 2.20 | 0.80 | 0.20 | 0.15 | 0.20 | 0.075 | — | — | — | 0.012 | 0.005 | 0.018 | 0.0051 | 0.0013 |
| C | 0.41 | 2.18 | 0.80 | 0.19 | — | — | 0.075 | — | — | — | 0.009 | 0.003 | 0.015 | 0.0048 | 0.0008 |
| D | 0.42 | 2.20 | 0.80 | 0.20 | — | 0.30 | 0.075 | — | — | — | 0.005 | 0.006 | 0.026 | 0.0033 | 0.0012 |
| E | 0.42 | 2.20 | 0.80 | 0.20 | 0.50 | — | 0.075 | — | — | — | 0.003 | 0.015 | 0.044 | 0.0045 | 0.0011 |
| F | 0.42 | 2.20 | 0.80 | 0.20 | 0.28 | 0.20 | 0.075 | — | — | — | 0.006 | 0.012 | 0.023 | 0.0061 | 0.0010 |
| F2 | 0.42 | 2.20 | 0.80 | 0.20 | 0.28 | 0.20 | 0.075 | — | — | 0.0020 | 0.006 | 0.012 | 0.023 | 0.0061 | 0.0010 |
| G | 0.42 | 2.20 | 0.80 | — | 0.29 | 0.20 | 0.075 | — | — | — | 0.015 | 0.017 | 0.033 | 0.0025 | 0.0009 |
| H | 0.47 | 2.45 | 0.93 | — | — | 0.50 | 0.051 | 0.020 | — | — | 0.013 | 0.011 | 0.016 | 0.0066 | 0.0007 |
| I | 0.38 | 2.48 | 1.14 | 0.35 | — | — | 0.095 | — | — | — | 0.012 | 0.010 | 0.005 | 0.0035 | 0.0005 |
| J | 0.43 | 1.95 | 0.77 | 0.35 | 0.22 | 0.35 | 0.100 | — | — | — | 0.013 | 0.015 | 0.004 | 0.0028 | 0.0010 |
| K | 0.45 | 1.91 | 0.61 | 0.35 | 0.25 | — | 0.098 | — | — | — | 0.011 | 0.015 | 0.025 | 0.0055 | 0.0014 |
| L | 0.37 | 1.88 | 0.40 | 0.33 | 0.22 | — | 0.081 | — | — | — | 0.008 | 0.009 | 0.006 | 0.0061 | 0.0008 |
| M | 0.47 | 2.15 | 0.77 | 0.37 | 0.12 | 0.15 | 0.051 | — | — | — | 0.006 | 0.003 | 0.008 | 0.0055 | 0.0011 |
| N | 0.56 | 1.40 | 0.70 | 0.67 | — | — | — | — | — | — | 0.003 | 0.002 | 0.015 | 0.0048 | 0.0012 |
| O | 0.61 | 1.95 | 0.90 | 0.15 | — | — | — | — | — | — | 0.005 | 0.004 | 0.012 | 0.0044 | 0.0015 |
| P | 0.60 | 1.52 | 0.52 | 0.55 | — | — | — | — | 0.165 | — | 0.004 | 0.012 | 0.025 | 0.0033 | 0.0014 |
| Q | 0.41 | 1.71 | 0.18 | 1.01 | 0.22 | 0.52 | 0.075 | — | 0.152 | — | 0.011 | 0.013 | 0.024 | 0.0048 | 0.0013 |
| R | 0.41 | 1.75 | 0.20 | 1.05 | 0.27 | 0.40 | 0.060 | — | — | — | 0.012 | 0.005 | 0.016 | 0.0049 | 0.0007 |
| S | 0.48 | 1.95 | 0.75 | 0.18 | 0.19 | 0.30 | 0.075 | — | 0.150 | — | 0.015 | 0.006 | 0.035 | 0.0051 | 0.0005 |
| T | 0.48 | 1.95 | 0.80 | 0.20 | 0.15 | 0.25 | 0.060 | — | — | — | 0.005 | 0.008 | 0.044 | 0.0043 | 0.0008 |

TABLE 4

| STEEL KIND | $A_{1(C=0)}$ (° C.) | $A_{3(C=0)}$ (° C.) | $A_{4(C=0)}$ (° C.) | HEATING TEMPER-ATURE (° C.) | MINIMUM ROLLING TEMP. (° C.) | MAXIMUM REACHING TEMP. DURING FINISH ROLLING (° C.) | PLACING TEMP. (° C.) | COIL CLOSE PARTS COOLING SPEED (° C./s) | COIL COARSE PARTS COOLING SPEED (° C./s) |
|---|---|---|---|---|---|---|---|---|---|
| A | 950 | 1100 | 1250 | 1200 | 900 | 1180 | 965 | 1.8 | 7.5 |
| B | 950 | 1090 | 1260 | 1150 | 1000 | 1180 | 955 | 2.2 | 7.0 |
| C | 975 | 1180 | 1200 | 1150 | 900 | 1190 | 980 | 2.1 | 6.3 |
| D | 950 | 1080 | 1270 | 1180 | 910 | 1150 | 955 | 1.5 | 5.5 |
| E | 950 | 1100 | 1250 | 1200 | 950 | 1150 | 950 | 1.5 | 5.8 |
| F | 940 | 1080 | 1270 | 1190 | 940 | 1150 | 970 | 2.0 | 7.9 |
| F2 | 940 | 1080 | 1270 | 1200 | 950 | 1160 | 950 | 1.8 | 5.4 |
| G | 950 | 1090 | 1270 | 1180 | 920 | 1150 | 970 | 2.5 | 5.5 |
| H | 940 | 1090 | 1270 | 1200 | 900 | 1180 | 990 | 2.5 | 6.5 |
| I | 960 | 1160 | 1190 | 1180 | 930 | 1180 | 975 | 3.2 | 6.0 |
| J | 920 | 1030 | 1300 | 1180 | 900 | 1190 | 970 | 3.5 | 6.0 |
| K | 960 | 1080 | 1250 | 1140 | 900 | 1190 | 980 | 3.0 | 6.2 |
| L | 980 | 1130 | 1210 | 1150 | 910 | 1180 | 1000 | 3.0 | 5.8 |
| M | 940 | 1070 | 1270 | 1200 | 910 | 1180 | 955 | 5.4 | 7.0 |
| N | 910 | 970 | 1340 | 1280 | 900 | 1150 | 930 | 1.5 | 4.5 |
| O | 945 | 1025 | 1315 | 1300 | 900 | 1150 | 945 | 1.2 | 4.5 |
| P | 870 | 1025 | 1290 | 1250 | 900 | 1150 | 940 | 1.8 | 7.0 |
| Q | 925 | 1050 | 1250 | 1200 | 950 | 1150 | 970 | 2.2 | 6.1 |
| R | 920 | 1015 | 1290 | 1200 | 950 | 1200 | 925 | 1.5 | 7.7 |
| S | 925 | 1080 | 1270 | 1200 | 900 | 1180 | 975 | 5.2 | 7.0 |
| T | 920 | 1025 | 1310 | 1250 | 925 | 1180 | 940 | 3.2 | 5.6 |

TABLE 5

| STEEL KIND | DmT (mm) | DmF (mm) | VICKERS HARDNESS | CONVERTED TS (MPa) | Ceq1 | ASPECT RATIO | Ceq2 | LIFE FOR HYDROGEN EMBRIT-TLEMENT CRACK (s) | Ceq3 | FATIGUE STRENGTH (MPa) |
|---|---|---|---|---|---|---|---|---|---|---|
| A | 0.15 | 0.00 | 550 | 1919 | 0.596 | 0.66 | 0.285 | 1052 | 0.477 | 300 |
| B | 0.18 | 0.00 | 558 | 1948 | 0.600 | 0.70 | 0.345 | 980 | 0.517 | 310 |
| C | 0.18 | 0.00 | 555 | 1937 | 0.598 | 0.85 | 0.467 | 999 | 0.486 | 290 |
| D | 0.09 | 0.00 | 555 | 1937 | 0.595 | 0.76 | 0.435 | 945 | 0.527 | 300 |
| E | 0.19 | 0.00 | 561 | 1958 | 0.610 | 0.48 | 0.130 | 845 | 0.497 | 290 |
| F | 0.18 | 0.00 | 555 | 1937 | 0.600 | 0.52 | 0.254 | 902 | 0.517 | 310 |
| F2 | 0.13 | 0.00 | 553 | 1948 | 0.600 | 0.65 | 0.254 | 810 | 0.517 | 290 |
| G | 0.08 | 0.00 | 551 | 1923 | 0.596 | 0.51 | 0.187 | 1121 | 0.477 | 290 |
| H | 0.16 | 0.00 | 564 | 1966 | 0.649 | 0.80 | 0.395 | 851 | 0.561 | 290 |
| I | 0.18 | 0.00 | 550 | 1918 | 0.580 | 0.84 | 0.485 | 988 | 0.540 | 300 |
| J | 0.18 | 0.00 | 548 | 1913 | 0.580 | 0.65 | 0.329 | 952 | 0.553 | 290 |
| K | 0.15 | 0.00 | 561 | 1958 | 0.624 | 0.60 | 0.380 | 1063 | 0.503 | 290 |
| L | 0.12 | 0.00 | 533 | 1857 | 0.555 | 0.68 | 0.315 | 1218 | 0.385 | 270 |
| M | 0.15 | 0.00 | 570 | 1988 | 0.653 | 0.98 | 0.475 | 580 | 0.612 | 270 |
| N | 0.08 | 0.00 | 588 | 2047 | 0.678 | 1.12 | 0.761 | 215 | 0.806 | 200 |
| O | 0.15 | 0.00 | 625 | 2155 | 0.765 | 1.12 | 0.655 | 150 | 0.778 | 200 |
| P | 0.08 | 0.00 | 615 | 2127 | 0.742 | 1.15 | 0.765 | 181 | 0.774 | 220 |
| Q | 0.12 | 0.00 | 545 | 1902 | 0.580 | 0.98 | 0.481 | 889 | 0.572 | 280 |
| R | 0.12 | 0.00 | 548 | 1912 | 0.590 | 1.01 | 0.476 | 725 | 0.585 | 280 |
| S | 0.15 | 0.00 | 565 | 1972 | 0.631 | 0.68 | 0.356 | 854 | 0.581 | 250 |
| T | 0.18 | 0.00 | 558 | 1946 | 0.630 | 0.76 | 0.398 | 790 | 0.606 | 250 |

The results of Tables 3-5 indicate that the steel kinds A-K, in which ferrite decarburization does not occur and requirements of the present invention with respect to Ceq1-3 are satisfied, show excellent corrosion fatigue strength (290 MPa or more, for example). On the other hand, in the steel kind L with Ceq1 being lower than 0.580, Vickers hardness is low and, consequently, fatigue strength is low. In the steel kinds N-P with Ceq2 being over 0.49, the aspect ratio of corrosion pits is large and, consequently, fatigue strength is low. In the steel kinds M-T with Ceq3 being over 0.570, life for hydrogen embrittlement crack is short and, consequently, fatigue strength is low.

Further, as is shown from the results of Tables 3-5, in the steel in which ferrite decarburization is prevented, Vickers hardness, aspect ratio of corrosion pits and life for hydrogen embrittlement crack of it affect corrosion fatigue strength. Also, as is shown from the graphs of FIGS. 1-3, these Vickers hardness, aspect ratio of corrosion pits and life for hydrogen embrittlement crack have extremely high correlation with Ceq1-3. Accordingly, by adjusting the chemical composition of steel to satisfy the requirements of the present invention with respect to Ceq1-3, Vickers hardness, aspect ratio of corrosion pits and life for hydrogen embrittlement crack can be controlled, and excellent corrosion fatigue strength can be achieved.

What is claimed is:

1. A steel wire material, wherein the steel wire material has a composition comprising iron and impurities and, in mass %:

C: 0.37-0.54%;

Si: 1.7-2.30%;

Mn: 0.1-1.30%;

Cr: 0.15-1.1%;

Cu: 0.15-0.6%;

Ti: 0.010-0.1%; and

Al: 0.003-0.05%, wherein a depth of a ferrite decarburized layer of the material is 0.01 mm or less, a depth of a whole decarburized layer of the material is 0.20 mm or less, and a fracture reduction of area of the material is 25% or more.

2. The steel wire material according to claim 1, wherein the composition further comprises Ni: 0.15-0.7%.

3. The steel wire material according to claim 1, wherein the composition further comprises at least one of V: 0.07-0.4% and Nb: 0.01-0.1%.

4. The steel wire material according to claim 1, wherein the composition further comprises Mo: 0.01-0.3%.

5. The steel wire material according to claim 1, wherein the composition further comprises 0.020% or less of P, 0.020% or less of S, 0.0070% or less of N, and 0.0015% or less of O.

6. A method for producing the steel wire material according to claim 1, comprising hot rolling a steel, and coiling the steel to form a coil, and cooling the coil on a cooling bed, wherein $A_1$ transformation point, $A_3$ transformation point, and $A_4$ transformation point at C=0 wt % in a phase equilibrium diagram of the steel are designated respectively as $A_{1(c=o)}$ transformation point, $A_{3(c=0)}$ transformation point, $A_{4(c=0)}$ transformation point, wherein the method further comprises heating the steel before the hot rolling in a range of from 900° C. or higher to the $A_{4(c=o)}$ transformation point, wherein a maximum reaching temperature of the steel during finish rolling of the hot rolling is in a range of from $A_{3(c=0)}$ transformation point to the $A_{4(c=0)}$ transformation point, placing the coil onto the cooling bed at a temperature in a range of from the $A_{1(c=o)}$ transformation point to the $A_{1(c=0)}$ transformation point +50° C., and cooling the coil in a temperature range where ferrite precipitates according to a continuous cooling curve corresponding to 8.0-11 crystal grain size number of austenite grains at a cooling speed of 1.0° C./s or faster at close parts of the coil and at a cooling speed of 8° C./s or slower at rough parts of the coil.

7. A method for producing the steel wire material according to claim 1, comprising hot rolling a steel, coiling the steel to form a coil, and cooling the coil on a cooling bed, wherein the method further comprises heating the steel before the hot rolling in a range of from 900° C. or higher to 1,250° C., wherein a maximum reaching temperature of the steel during finish rolling of the hot rolling is in a range of from 1,050° C. to 1,200° C., placing the coil onto the cooling bed at a temperature in a range of from 900° C. to 980° C., and cooling the coil in a temperature range of from 750° C. to 600° C. at a cooling speed of 1.0° C./s or faster at close parts of the coil and at a cooling speed of 8° C./s or slower at rough parts of the coil.

8. The method for producing the steel wire material according to claim 6, comprising controlling the maximum reaching temperature of the steel during finish rolling by utilizing heat generation of the steel during the hot rolling without performing water cooling of the steel before finish rolling.

9. The method for producing the steel wire material according to claim 6, wherein an ideal critical diameter DCI of the steel as exhibited in equation (1) below is 75-135 mm, wherein $$DCI(\text{mm})=25.4\times(0.171+0.001[C]+0.265[C]^2)\times(3.3333[Mn]+1)\times(1+0.7[Si])\times(1+0.363[Ni])\times(1+2.16[Cr])\times(1+0.365[Cu])\times(1+1.73[V])\times(1+3[Mo]) \quad (1)$$

wherein [ ] shows a content (mass %) of each element in the steel.

10. A steel wire material, wherein the material has a composition comprising iron and inevitable impurities and, in mass %:

C: 0.38-0.47%;

Si: 1.9-2.5%;

Mn: 0.6-1.1%;

Ti: 0.05-0.15%; and

Al: 0.003-0.1%, wherein;

a depth of a ferrite decarburized layer is 0.01 mm or less,

Ceq1 is 0.580 or more,

Ceq2 is 0.49 or less, and

Ceq3 is 0.570 or less, wherein $$Ceq1=[C]+0.11[Si]-0.07[Mn]-0.05[Ni]+0.02[Cr];$$

$$Ceq2=[C]+0.30[Cr]-0.15[Ni]-0.70[Cu]; \text{ and}$$

$$Ceq3=[C]-0.04[Si]+0.24[Mn]+0.10[Ni]+0.20[Cr]-0.89[Ti]-1.92[Nb],$$

wherein [ ] shows a content (mass %) of each element in the steel.

11. The steel wire material according to claim 10, wherein the composition further comprises Cr: 0.1-0.4%.

12. The steel wire material according to claim 10, wherein the composition further comprises Cu: 0.1-0.7%.

13. The steel wire material according to claim 10, wherein the composition further comprises Ni: 0.1-0.7%.

14. The steel wire material according to claim 10, wherein the composition further comprises Nb: 0.01-0.1%.

15. The steel wire material according to claim 10, wherein the composition further comprises 0.02% or less of P, 0.02% or less of S, 0.007% or less of N, and 0.0015% or less of O.

16. The steel wire material according to claim 10, wherein the material has an average value of aspect ratios of corrosion pits at 0.9 or less, wherein $$\text{Aspect ratio}=(\text{corrosion pit depth}\times 2)/(\text{corrosion pit width}),$$

wherein the corrosion pits are obtained by a corrosion test, wherein after the steel wire material is heated at a temperature of 925° C. for 10 minutes, the material is cooled and oil quenched by the oil having a temperature at 70° C., the material is heat treated at 400° C. for 60 minutes, a surface of a test piece of the steel is polished with a #800 emery paper;

5 wt % NaCl aqueous solution is sprayed to the test piece at 35° C. for 8 hours in accordance with HS Z 2371, the test piece is treated in the wet environment of 60% humidity at a temperature of 35° C. for 16 hours as one cycle and carrying out the treating the test piece in a total of 14 cycles; and rust on the surface of the test piece is removed and then the corrosion pits on the surface of the test piece are observed by a laser microscope.

17. The steel wire material according to claim 1, wherein the composition further comprises B: 0.0003-0.005%.

18. A steel wire material, wherein the steel wire material has a composition comprising iron and impurities and, in mass %:

C: 0.37-0.54%;
Si: 1.7-2.30%;
Mn: 0.1-0.9%;
Cr: 0.15-1.1%;
Cu: 0.15-0.6%;
Ti: 0.010-0.1%; and
Al: 0.003-0.05%,
wherein
a depth of a ferrite decarburized layer of the material is 0.01 mm or less,
a depth of a whole decarburized layer of the material is 0.20 mm or less, and
a fracture reduction of area of the material is 25% or more.

19. A method for producing the steel wire material according to claim 18 comprising hot rolling a steel, coiling the steel to form a coil, and cooling the coil on a cooling bed, wherein the method further comprises heating the steel before the hot rolling in a range of from 900° C. or higher to 1,250° C., wherein a maximum reaching temperature of the steel during finish rolling of the hot rolling is in a range of from 1,050° C. to 1,200° C., placing the coil onto the cooling bed at a temperature in a range of from 900° C. to 980° C., and cooling the coil in a temperature range of from 750° C. to 600° C. at a cooling speed of 1.0° C./s or faster at close parts of the coil and at a cooling speed of 8° C./s or slower at rough parts of the coil.

20. The steel wire material according to claim 10, wherein the steel wire material has a fracture reduction of area of 25% or more.

21. The steel wire material according to claim 10, wherein the material has a corrosion fatigue strength of 290 MPa or more.

22. The steel wire material according to claim 1, wherein the material has a tensile strength in a range of from 1050 MPa to 1320 MPa.

23. The steel wire material according to claim 1, wherein the material has a tensile strength in a range of from 1050 MPa to 1180 MPa.

24. The steel wire material according to claim 10, wherein the material has a tensile strength in a range of from 1050 MPa to 1320 MPa.

25. The steel wire material according to claim 10, wherein the material has a tensile strength in a range of from 1050 MPa to 1180 MPa.

* * * * *